US010364056B2

(12) United States Patent
Schwarzli et al.

(10) Patent No.: US 10,364,056 B2
(45) Date of Patent: Jul. 30, 2019

(54) BAGGING SYSTEM FOR A VENDING MACHINE

(71) Applicant: BEAVER MACHINE CORPORATION, Newmarket (CA)

(72) Inventors: Bernie Schwarzli, Newmarket (CA); Mark Rendell, Newmarket (CA)

(73) Assignee: BEAVER MACHINE CORPORATION, Newmarket (CA)

( * ) Notice: Subject to any disclaimer, the term of this patent is extended or adjusted under 35 U.S.C. 154(b) by 530 days.

(21) Appl. No.: 14/648,092

(22) PCT Filed: Nov. 28, 2013

(86) PCT No.: PCT/CA2013/000993
§ 371 (c)(1),
(2) Date: May 28, 2015

(87) PCT Pub. No.: WO2014/082161
PCT Pub. Date: Jun. 5, 2014

(65) Prior Publication Data

US 2015/0314898 A1 Nov. 5, 2015

(30) Foreign Application Priority Data

Nov. 29, 2012 (CA) ..... 2797543

(51) Int. Cl.
*B65B 43/42* (2006.01)
*B65B 43/46* (2006.01)
(Continued)

(52) U.S. Cl.
CPC ..... *B65B 43/465* (2013.01); *B65B 1/04* (2013.01); *B65B 43/30* (2013.01); *B65B 61/025* (2013.01); *G07F 11/44* (2013.01); *G07F 13/10* (2013.01)

(58) Field of Classification Search
CPC ..... B65B 43/42–465
(Continued)

(56) References Cited

U.S. PATENT DOCUMENTS 4,353,198 A * 10/1982 Koppe ..... B65B 1/02 53/284.7
6,112,539 A 9/2000 Colberg
(Continued)

FOREIGN PATENT DOCUMENTS

EP 1964785 A2 9/2008

OTHER PUBLICATIONS

International Search Report for App. No. PCT/CA2013/000993 dated Feb. 5, 2014.

*Primary Examiner* — Chelsea E Stinson
(74) *Attorney, Agent, or Firm* — Ralph E. Jocke; Walker & Jocke

(57) ABSTRACT

A bagging system for a vending machine provides a bag loading device for loading the bag to a bag holder. The bag holder includes clamping arms for clamping opposed side edges of the bag to retain the bag in position for filling. The clamping arms are movable between a position wherein the top of the bag is generally stretched taut and a position wherein the top of the bag is slackened to thereby allow the top opening of the bag to open so that the product can be dispensed into the bag. The product may be associated with a data providing element for providing data relating to the product or a security code, or both, to the vending machine processor.

10 Claims, 41 Drawing Sheets

(51) Int. Cl.

| | |
|---|---|
| ***B65B 1/04*** | (2006.01) |
| ***B65B 43/30*** | (2006.01) |
| ***B65B 61/02*** | (2006.01) |
| ***G07F 13/10*** | (2006.01) |
| ***G07F 11/44*** | (2006.01) |

(58) Field of Classification Search
USPC ..... 53/450, 457, 459, 467, 468, 469, 53/473–475, 481
See application file for complete search history.

(56) References Cited

U.S. PATENT DOCUMENTS

| | | | | |
|---|---|---|---|---|
| 2003/0222091 | A1 | 4/2003 | Gerold et al. | |
| 2005/0092389 | A1 | 5/2005 | Mazur et al. | |
| 2011/0138751 | A1* | 6/2011 | Nakagawa ..... | B65B 43/50 53/469 |
| 2012/0292223 | A1* | 11/2012 | Chenail ..... | B65B 35/50 206/524.1 |

* cited by examiner 6
100a
100

4
104
102

100
3
112
110
4
124
126
102
120
110
112
130
142
72

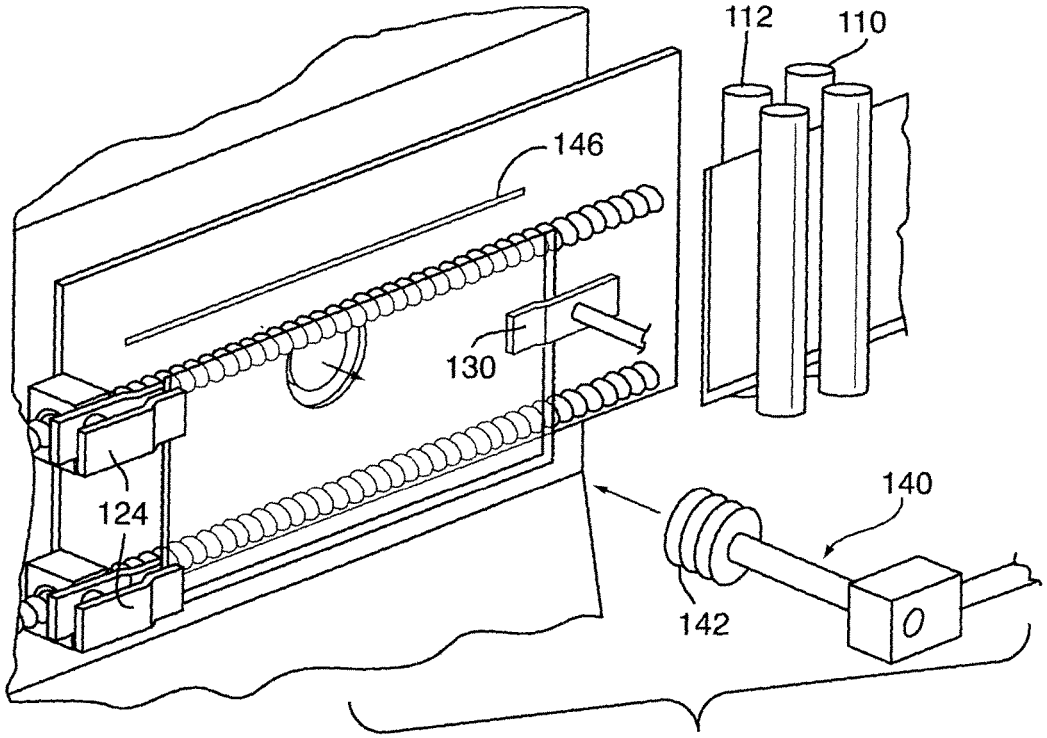
Fig.27
Fig.28
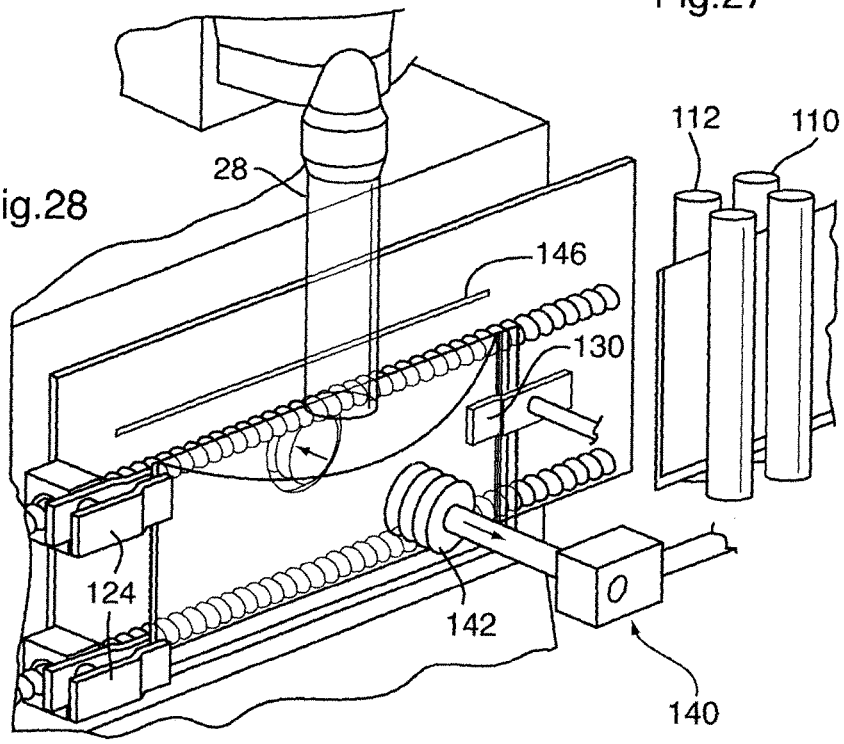

Fig.29
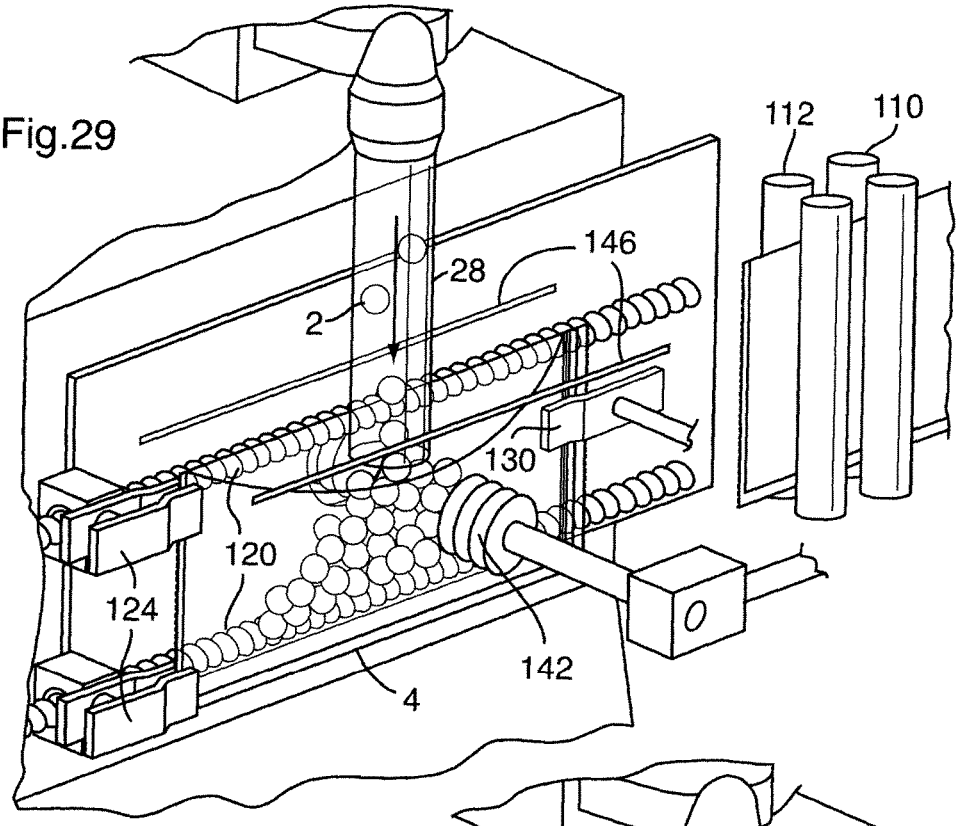
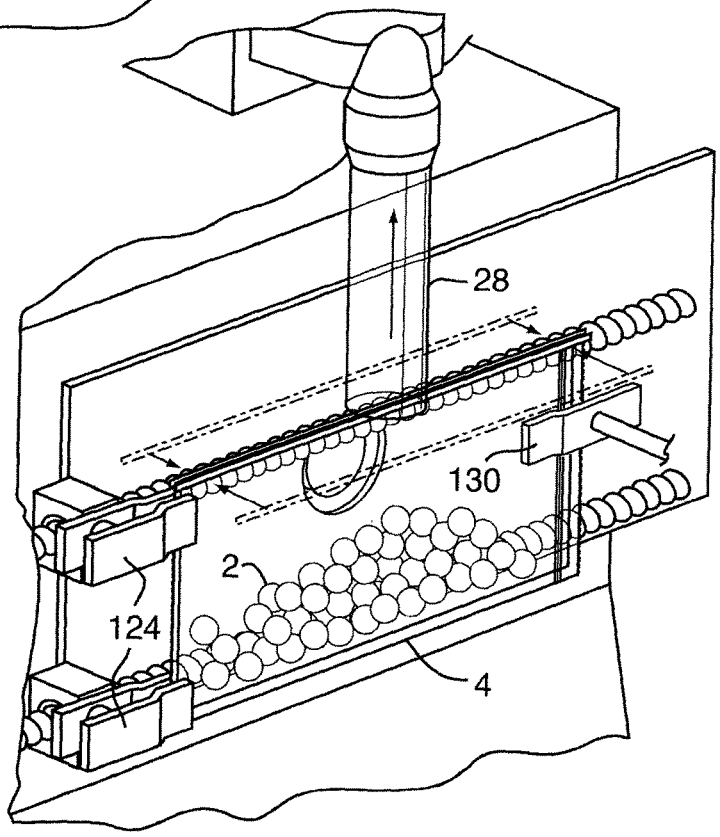
Fig.30

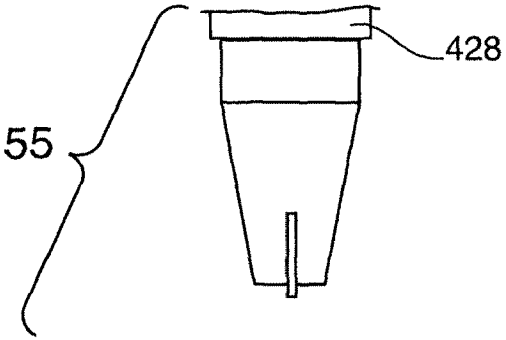
Fig.55
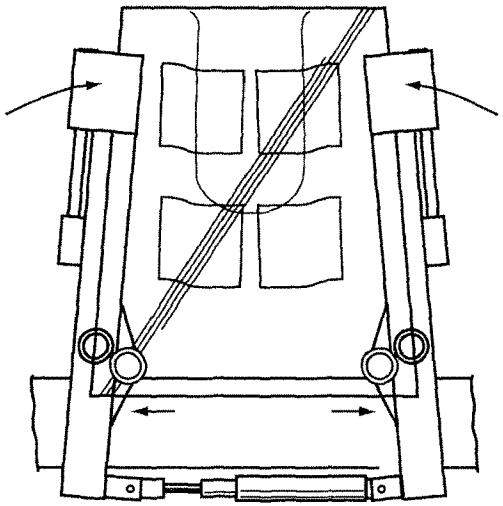
Fig.54
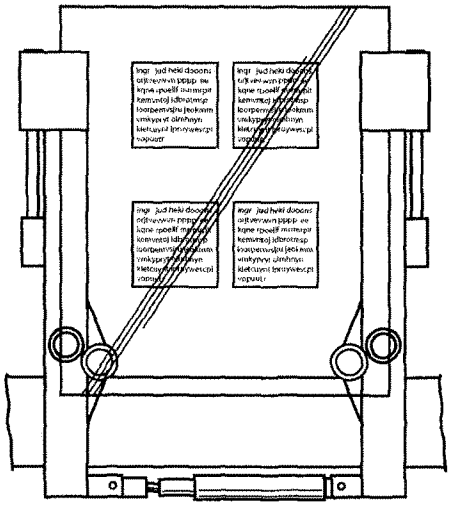
Fig.53
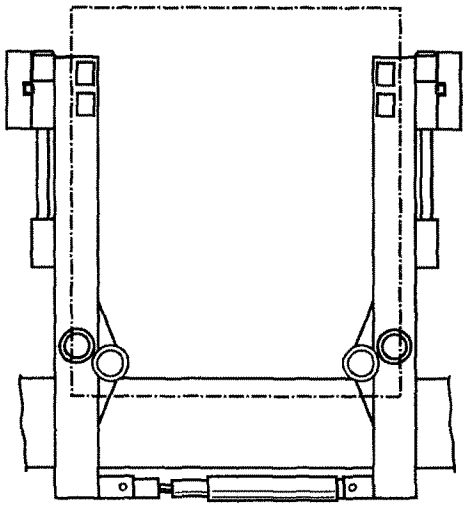

Fig.57
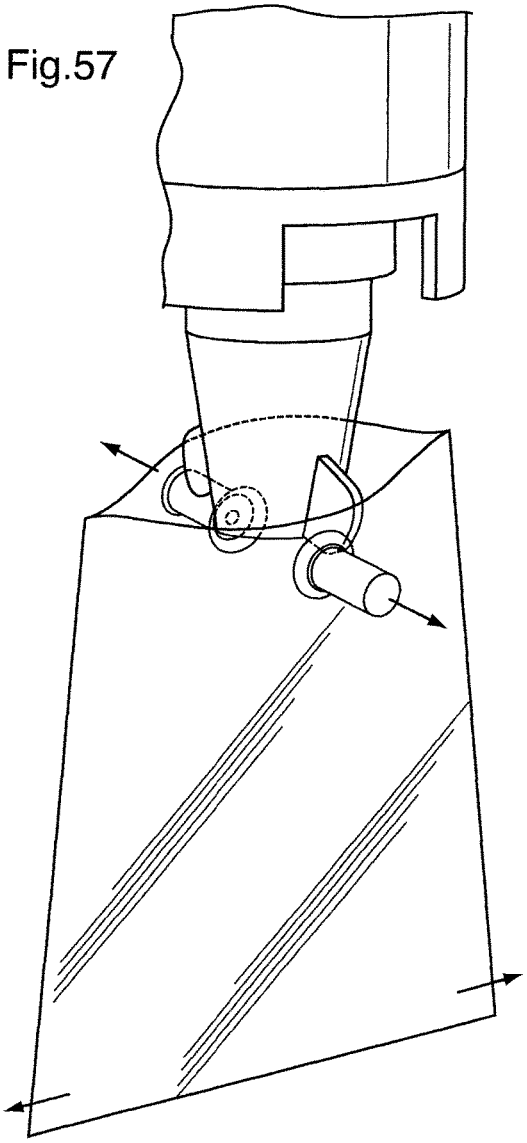
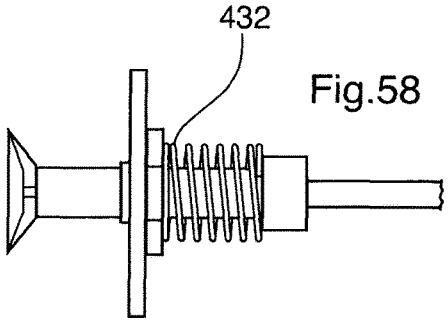
Fig.58
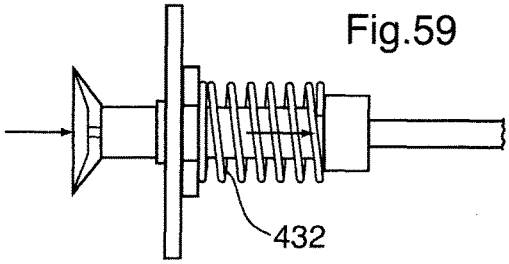
Fig.59

440
442

BAGGING SYSTEM FOR A VENDING MACHINE

TECHNICAL FIELD

A vending machine is provided. In particular, a bagging system for packaging product dispensed by one or more bulk vending machines is provided.

BACKGROUND

Vending machines are a very popular method of selling merchandise. Bulk venders, for example, in which a metered amount of product stored in bulk in a bin is dispensed upon payment of a required amount of money, can be used for the self-service purchase of myriad types of products. Such vending machines provide a cost-effective way of selling bulk product, in part because they can be located in unsupervised locations and therefore involve very low overhead.

One of the consequences of locating a vending machine in an unsupervised location is that there is no salesperson to attract purchasers or interest prospective customers in the products being vended. The vending machine itself must have a sufficiently interesting and appealing presence to attract purchasers and interest purchasers in the product. Bulk vending machines are nevertheless a popular way of selling small merchandise such as toys and confectionary, part of their popularity being due to the entertainment value associated with the action of a purchaser and the visible reaction of the machine in the dispensing of bulk product. Children in particular are attracted by the visual appeal of bulk product displayed and the product dispensing process. As such, bulk vending machines virtually universally stock product in transparent bins for the visual appeal, and are often manufactured with very large product bins and/or elaborate dispensing paths made deliberately viewable by the purchaser, to increase visual appeal and entertainment value of the vending machine.

For these reasons, while in the past it was common to provide a single bulk vender which stored a single type of product for dispensing to a purchaser, more recently it has become common to locate a cluster or group of bulk venders in one location, sometimes referred to as a bulk vending "island." This offers purchasers the choice of a variety of bulk product, for example different types of confectionaries, while at the same time increasing the visual appeal of the vending installation and thus increasing the attraction to prospective purchasers.

Systems have been designed for the selective actuation of one or more bulk venders in such a group of bulk venders actuated from a common control station. These systems have been known and used for many decades in self-contained vending machines which vend a variety of types of single articles. For example, in one such type of vending machine a plurality of a particular product item such as a candy bar, package of gum, bag of potato chips etc. is stocked in a coil which, when rotated, advances the product toward a dispensing portion of the machine. A window located at the front of the machine allows a purchaser to watch the dispensing operation. Multiple coils are provided for the vending of different items, each coil supporting a plurality of a particular item. In this type of vending machine a control panel is provided allowing the purchaser, following payment of the required amount, to select a particular article from the variety of articles stocked in the vender by entering an alphanumeric code visually associated with the coil containing the desired product. In response to the purchaser's selection, the coil containing the selected article is actuated through a single rotation, which in an auger-like fashion advances each article seated in the coil toward the front of the machine. By the end of the dispensing cycle the foremost product drops from the coil into a dispensing area accessible to the purchaser.

However, such machines are capable of dispensing only one item, and thus one product type, with each dispensing cycle. Similarly, in a conventional bulk vender island the selection of a product, whether directly or via a shared control panel, actuates only the particular vender containing the selected product and thus dispenses only the single type of product stored in the selected bulk vender. A purchaser may select product from different bulk venders in the island, but must purchase and collect the product from each bulk vender in separate individual transactions.

It would be advantageous to provide to purchasers an opportunity to create a mix of different product types, for example different types of confectionaries, in a single dispensing operation. Such venders would provide a virtually unlimited number of permutations and combinations of bulk mixtures, and allow a purchaser to select specific metered amounts of each product, the various products being dispensed into a single container.

Providing open rigid containers for receiving merchandise in such a multi-vender vending machine can result in dust or other contaminants accumulating in the container prior to a purchase. Also, automatically sealing a rigid container into which bulk product has been dispensed is an involved operation requiring both precision and the ability to accommodate slight deviations between containers, and is thus difficult to effect consistently.

Consumers in modern society are very health conscious, and need a high degree of confidence that the bulk product being dispensed is not contaminated. Consumers also often wish to know the nutritional content of foodstuffs being purchased, and in some regions regulations may require that the nutritional content and/or identification of ingredients of foodstuffs be made available to purchasers on food packages so that the information remains available after purchase of the product.

SUMMARY

In an exemplary embodiment, a bagging system for bagging product in a vending machine is provided. The bagging includes at least one vender for dispensing product into a top opening of a bag. The bagging system also includes a bag loading device for loading the bag to a bag holder. The bag holder further includes clamps for clamping opposed side edges of the bag adjacent to the top opening to retain the bag in position for filling. At least one of the clamps is movable between a first position wherein the top of the bag is generally stretched taut and a second position wherein the top of the bag is slackened, to thereby allow the top opening of the bag to be selectively opened and closed so that the product can be dispensed into the bag.

In another exemplary embodiment, a method of bagging product in a vending machine including at least one vender for dispensing product into a top opening of a bag is provided. The method includes a) loading the bag to a bag holder comprising clamping arms attached to a frame supporting clamps; b) clamping opposed side edges of the bag to retain the bag in position for filling; c) moving at least one of the clamps from a first position wherein the top of the bag is generally stretched taut to a second position wherein the top of the bag is slackened to thereby allow the top opening of the bag to open; and d) dispensing the product into the bag.

BRIEF DESCRIPTION OF THE DRAWINGS

FIG. 27 is a front perspective view of the bag loading system of FIG. 20 with the bag in a fully loaded position.

FIG. 28 is a front perspective view of the bag loading system of FIG. 20 with the bag opened for filling.

FIG. 29 is a front perspective view of the loaded bag in the bagging system of FIG. 20 being filled.

FIG. 30 is a front perspective view of the loaded bag in the bagging system of FIG. 20 being sealed by a sealing assembly.

FIG. 53 is a front elevational view of the shuttle of FIG. 46 with the bag held taut for printing and/or labelling.

FIG. 54 is a front elevational view of the shuttle of FIG. 46 with the bag printed and/or labelled.

FIG. 55 is a front elevational view of the shuttle of FIG. 46 with the bag top slackened for filling.

FIG. 57 is a schematic perspective view of the top of the bag being opened for filling.

FIG. 58 is a top plan view of a suction device in position for opening the bag top.

FIG. 59 is a top plan view of the suction device of FIG. 58 when the bag top is in the opened condition.

DETAILED DESCRIPTION

A vending machine for dispensing bulk product of different types into a single container is provided. The container in an exemplary embodiment may be a bag. According to the exemplary embodiment, a bagging system is provided whereby after a purchaser selects one or more of the plurality of bulk vender modules in the vending machine, a bag is loaded, opened and successively conveyed beneath each selected bulk vender to receive metered amounts of the bulk product selected by the purchaser. After the bag has been filled from each selected bulk vender module, the bag is sealed and dispensed to the user.

Thus, according to an exemplary embodiment, the user receives a hermetically sealed container filled with the bulk product selection of the user's choosing, which may comprise one or a plurality of different products such as confectionaries, and sealed to prevent contamination. In a further exemplary embodiment, product identifying information, nutritional information and/or other information or indicia is printed onto the container, or onto a label affixed to the container, after the bag is loaded and prior to the dispensing process.

Figure 1:
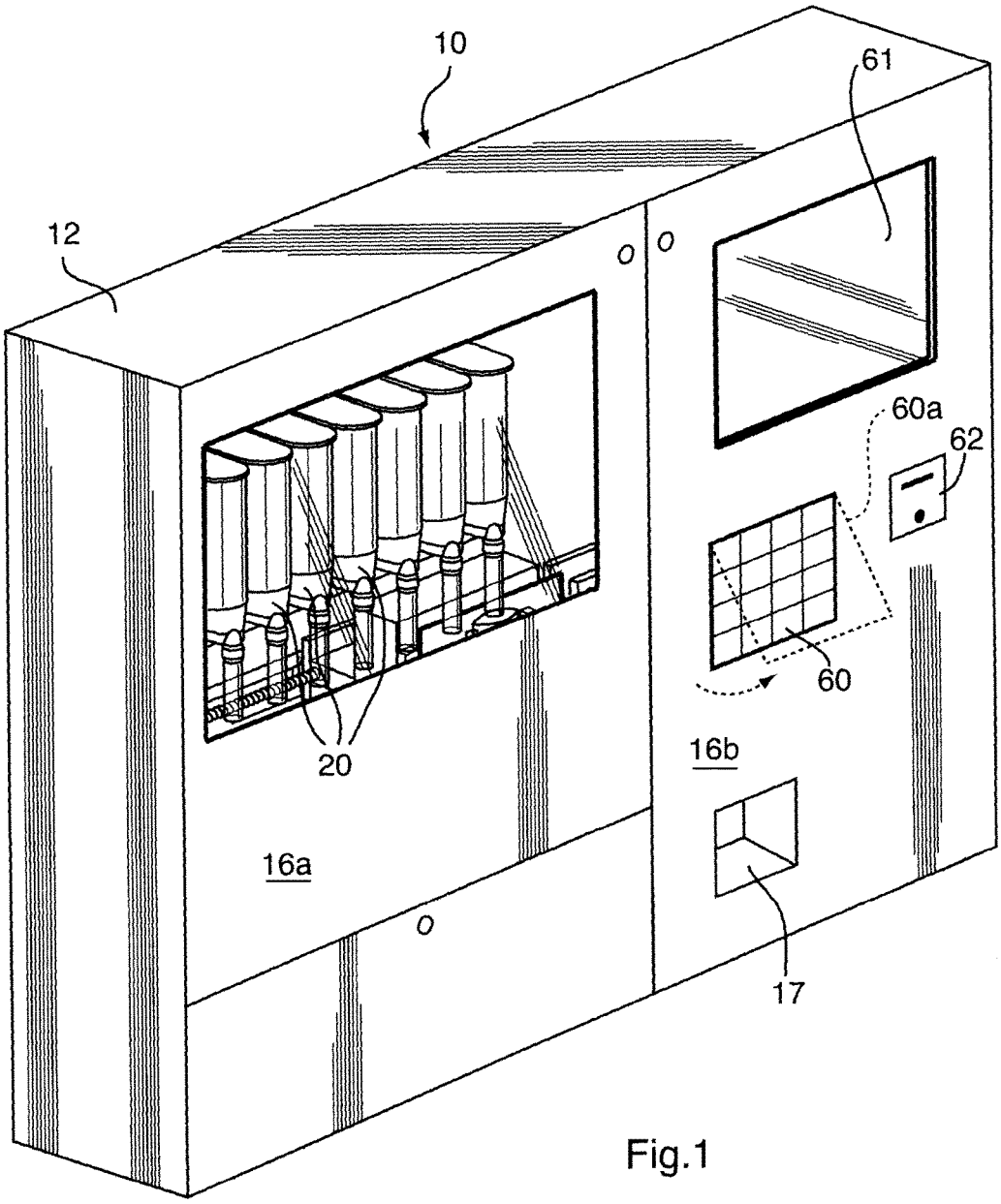
FIG. 1 is a front perspective view of a vending machine according to an exemplary embodiment.

FIG. 1 illustrates by way of example a vending machine 10. The vending machine 10 comprises a secure housing 12, which is provided with at least one door 16*a* allowing access to the interior of the housing 12, having a transparent glass or plastic window 14 positioned so that a purchaser can observe the dispensing operation. A second door 16*b* may be provided to facilitate servicing of the vending machine 10. A plurality of vender modules contained within the housing 12 allow for the stocking and vending of different types of product from the vending machine 10. One type of module, for example, is a bulk vender module 20. The bulk vender modules 20 may be disposed in generally horizontal alignment, as illustrated in FIGS. 1 and 2, and visible through the window 14.

In an exemplary embodiment, a user interface comprises a depressable or touch-sensitive keypad 60 (with an optional protective cover 60*a*, shown in phantom in FIG. 1) and a video monitor 61 operated by a processor with suitable drivers and/or other software (not shown). In an exemplary embodiment, the video monitor 61 displays purchase options prompting the user to make one or more selections, and transmits command signals to the processor based on the purchaser's input selection indicating the specific type of product desired to be purchased and the amount of product desired to be purchased from each vender module 20 (which is a multiple of the metered amount held by the dispensing slot 34, described below).

Figure 2:
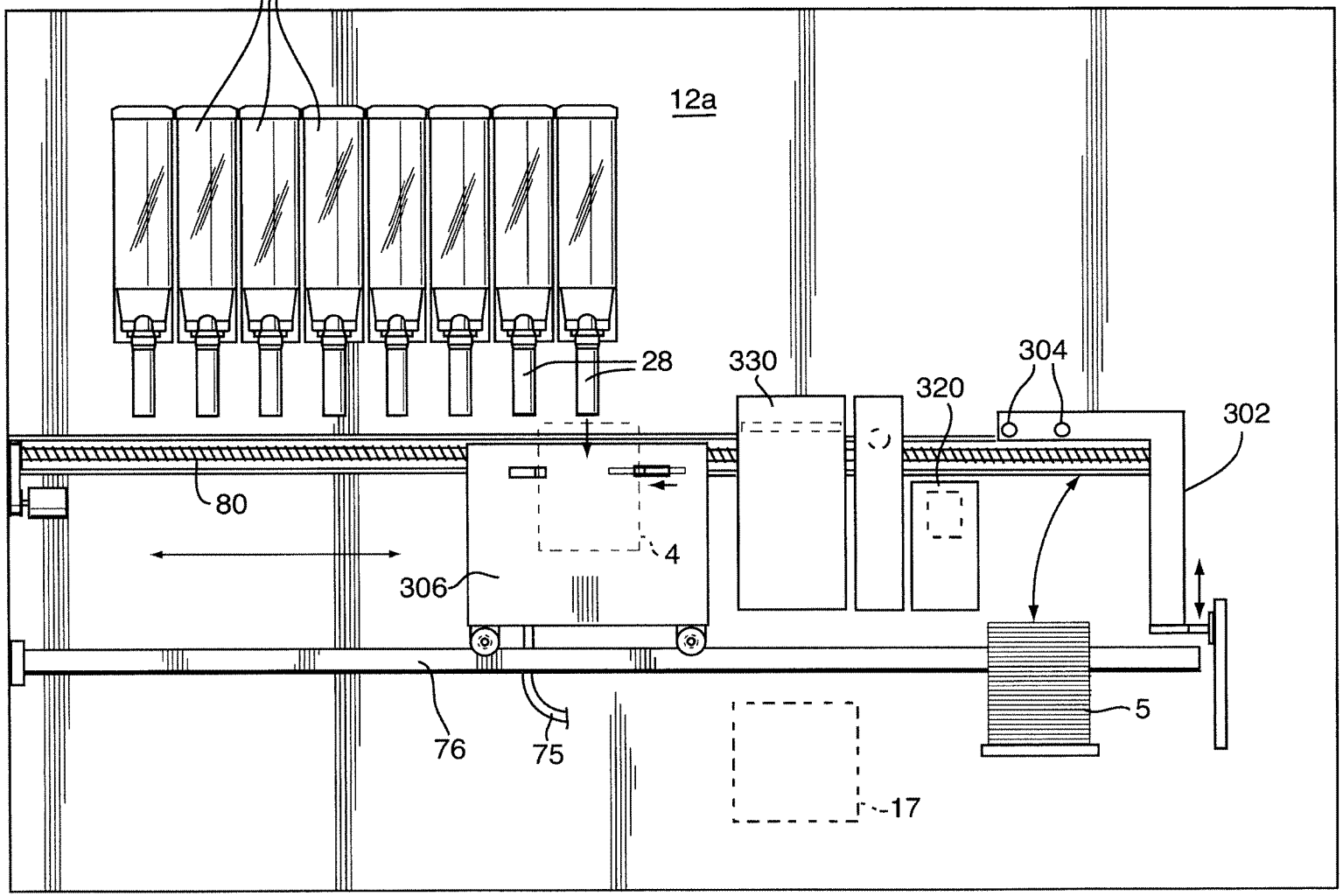
FIG. 2 is a front elevation of the internal components in one exemplary embodiment of the vending machine of FIG. 1.

FIGS. 1 and 2 illustrate a plurality of bulk vender modules 20 which are shown in detail in FIGS. 3 to 11. Each bulk vender module 20 comprises a storage section 22 covered by a lid 24, and a dispensing section contained within the base 25 and comprising a dispensing mechanism 30 which dispenses a metered amount of bulk product through a dispensing chute 28.

Figure 4:
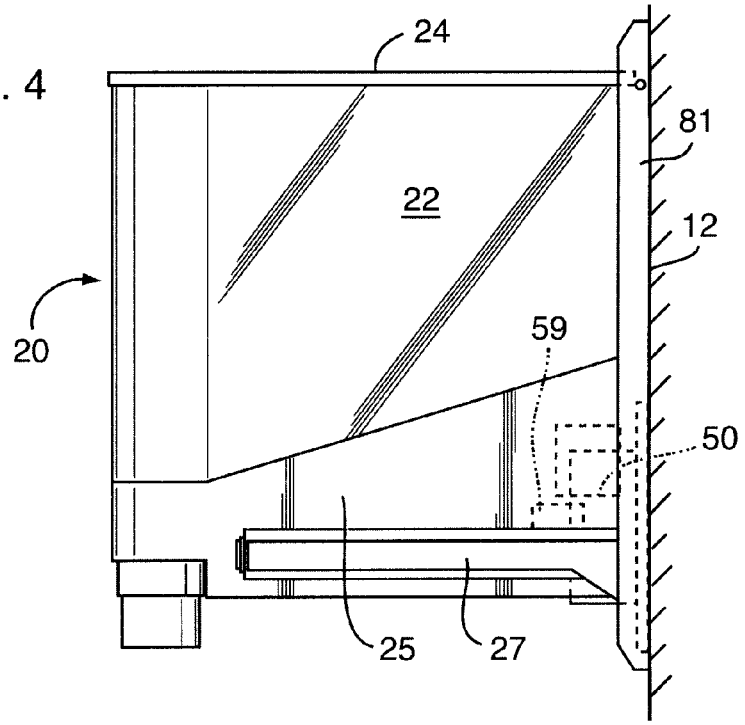
FIG. 4 is a side elevational view of the bulk vender module of FIG. 3 in an operating position.
Figure 15:
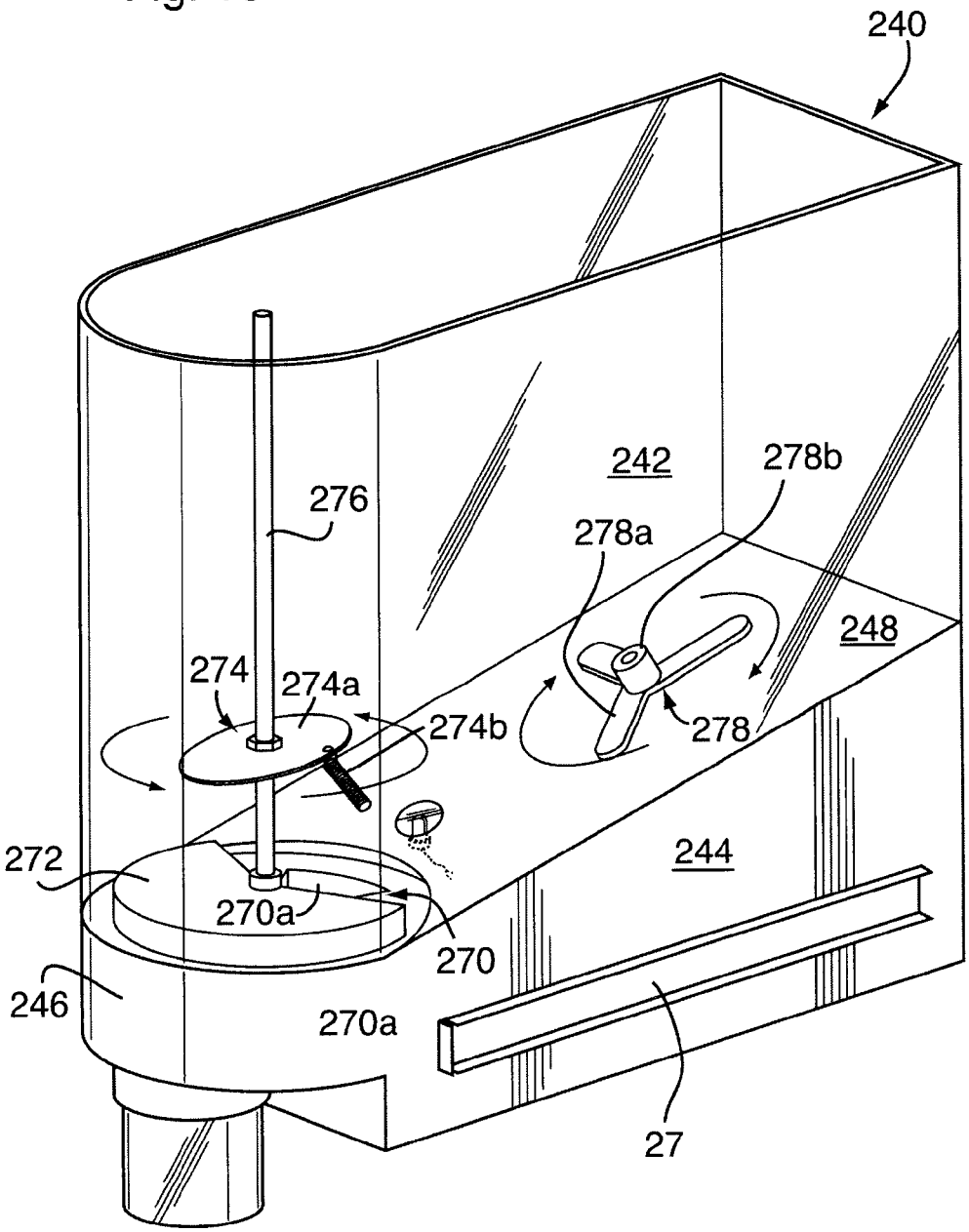
FIG. 15 is a perspective view of a further embodiment of a bulk vender module having primary and secondary agitators.

As shown in FIG. 4, each bulk vender module 20 is affixed to and supported by the housing 12, for example mounted to the rear wall 12*a* of the housing 12. In one embodiment, the bulk vender modules 20 may be disposed on extendable members such as conventional drawer tracks 27 (best seen in FIG. 5), allowing each vender module 20 to be independently pulled forward out of the front of the housing 12 for easier servicing and maintenance. In one embodiment, a quick-connect electrical connector 59 (shown in FIGS. 4 and 5) containing all electrical connections required for the vender module 20, for example the dispensing motor 50, any separate agitator motor, level sensors etc., decouples from a port (not shown) contained in the base 25 when the vender module 20 is slid out of the housing 12 for service, and recouples to restore the electrical connections when the vender module 20 is slid back into the housing 12 to its operating position. The product bin 22, which is also transparent so that the bulk product 2 stored in the vender 20 is visible to a purchaser through the window 14, is in communication with the dispensing mechanism 30 contained in the dispensing section. As shown in FIG. 6, in the embodiment illustrated, the dispensing mechanism 30 comprises a rotating dispensing member, for example, a dispensing drum 32. It will be appreciated that although a dispensing drum 34 has been shown by way of example, the dispensing mechanism in any particular vender 20 may alternatively be another type of dispensing mechanism, such as a rotary turntable as illustrated in FIG. 15, or any other suitable dispensing mechanism. In the embodiment illustrated in FIG. 6, the dispensing drum 32 comprises a dispensing slot 34 for receiving one or more stored product articles, such as confectionary items 2, during a portion of the dispensing cycle when the slot 34 is in communication with articles 2 in the product bin 22. In an exemplary embodiment, the slot 34 is in communication with articles 2 in the product bin 22 in the rest position of the dispensing drum 32, as shown in FIG. 6. The floor 21 of the product bin 22 is sloped toward the dispensing drum 32, to facilitate filling of the slot 34 when exposed to the bulk product items 2 stored within the product bin 22.

The dispensing drum 32 is mounted on an axle 36 which is in turn rotationally fixed to a drum gear 38. A drive affixed to the base 25 of the vender 20, for example an electric motor 50 having a drive shaft 52, rotates a drive gear 40 coupled to the drum gear 38 to rotate the drum 32 during the dispensing cycle.

Figure 10:
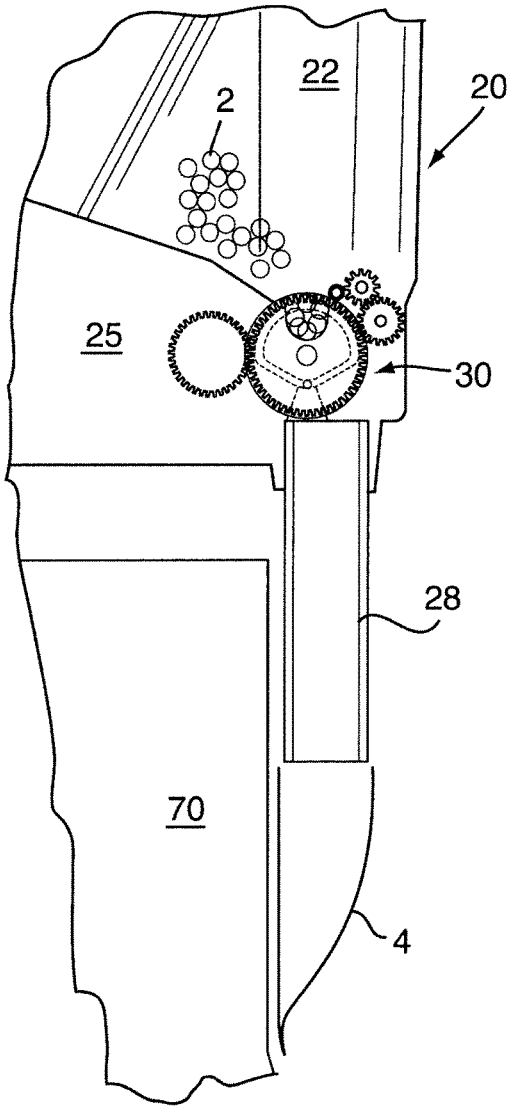
FIG. 10 is a partial side elevation of the bulk vender module showing the dispensing chute in a raised position.
Figure 11:
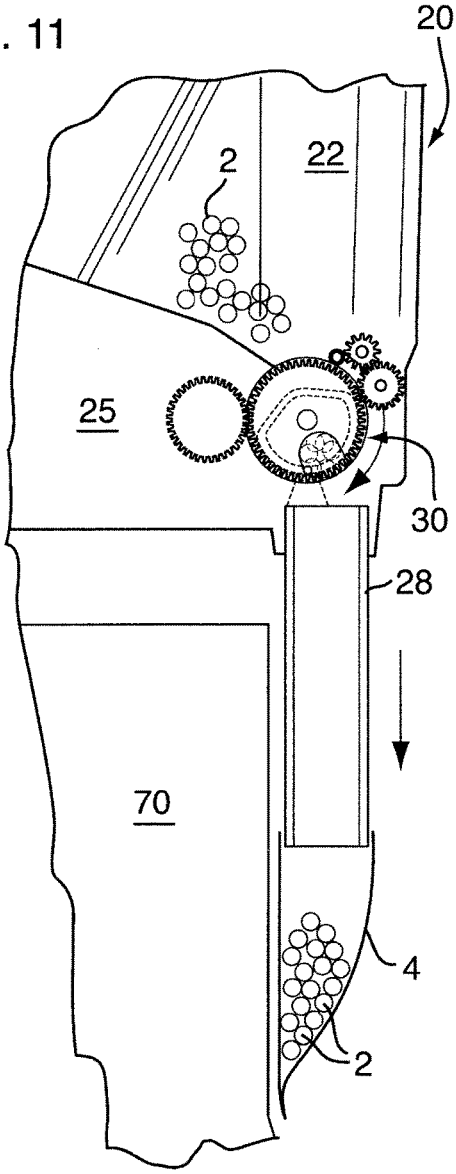
FIG. 11 is a partial side elevation of the bulk vender module showing the dispensing chute in a lowered position for filling a bag with product.

In an embodiment shown, the drum gear 38 comprises an eccentric groove or raceway 39 cut or milled into its face. A stud 42 from which a dispensing chute 28 is suspended is lodged in the raceway 39 and travels along the eccentric path defined by the raceway 39, raising and lowering the dispensing chute 28 as the gear 38 turns. Thus, with each rotation of the drum gear 38 the dispensing chute 28 cycles from a raised position with the lower end of the dispensing chute 28 positioned above the level of the opening of a bag 4, as shown in FIG. 10, and a lowered position with the lower end of the dispensing chute 28 positioned below the level of the opening of a bag 4, as shown in FIG. 11, and thus projecting into the bag 4 which has been loaded onto the bagging mechanism 70 in the manner described below.

Figure 12:
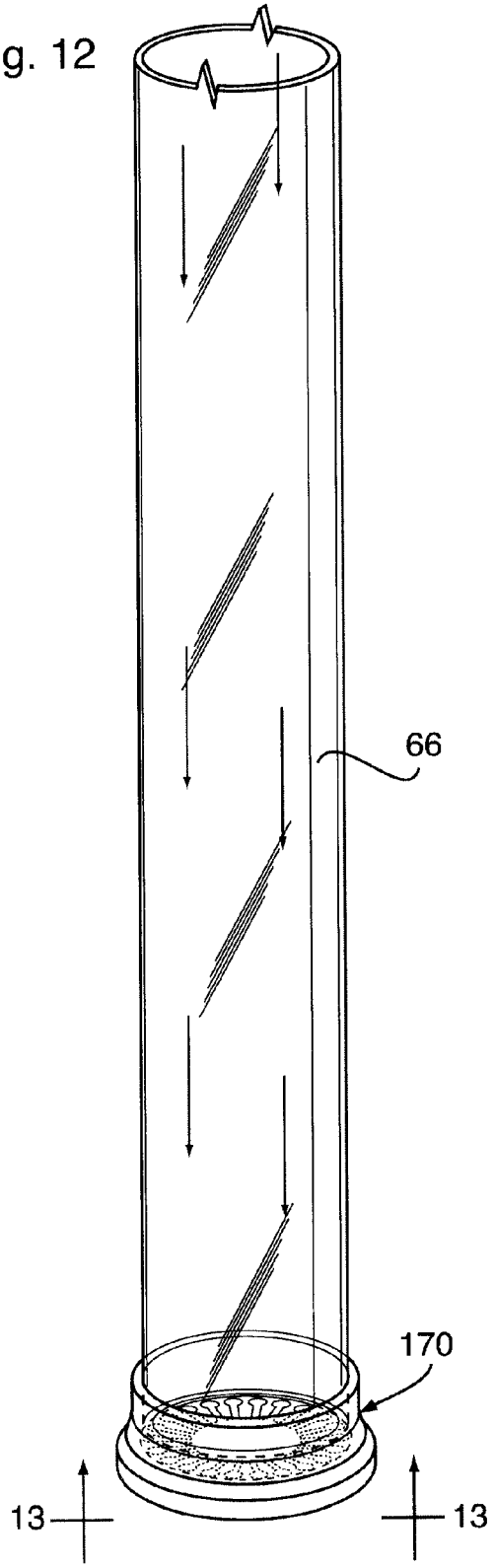
FIG. 12 is a perspective view of the dispensing chute.
Figure 13:
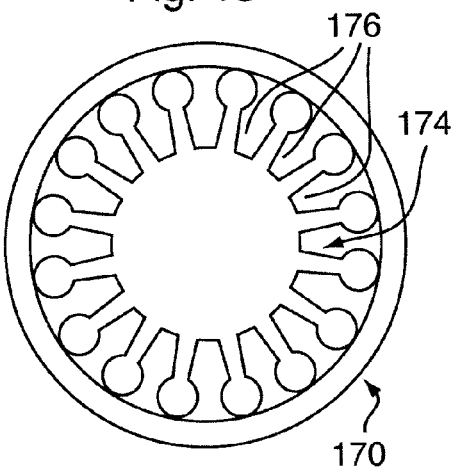
FIG. 13 is a plan view of a baffle disposed on the dispensing chute.
Figure 14:
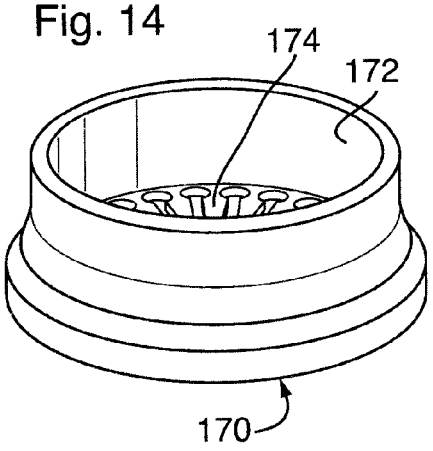
FIG. 14 is a perspective view of the baffle of FIG. 13.

Since product sold in a bulk vender is often breakable, such as candies and other confectionary, in order to avoid breakage of product as it is dispensed from the bulk vending modules 20 through the dispensing chute 28 and into the bag 4, a damper 170 may be provided, as illustrated in FIGS. 12 to 14. In an embodiment shown, the damper 170 comprises a collar 172 for friction fit over the lower end of the dispensing chute 28, and a baffle 174 comprising a series of resilient fingers 176 which extend radially toward the center of the dispensing chute 28 and yield under the force of falling product, slowing the descent of the articles 2. The damper 170 may be formed as an integral unit, for example, moulded from silicon or any other suitable resilient material, and slip-fitted over the lower end of the dispensing chute 28 in a friction fit.

In one embodiment, illustrated in FIG. 6, an optional sensor is provided to ensure that articles 2 from the product bin 22 are seated properly in the slot 34 before being dispensed. In the embodiment shown, a tubular resilient deflectable member, for example, a coil spring 90, is disposed above and close to the drum 32. The spring 90 is linear in a rest position. A light source such as a light emitting diode (LED) 92 is disposed in one end of the spring 90, and a light receiver sensitive to the frequency of the light source 92 is disposed in the other end of the spring 90.

Figure 18:
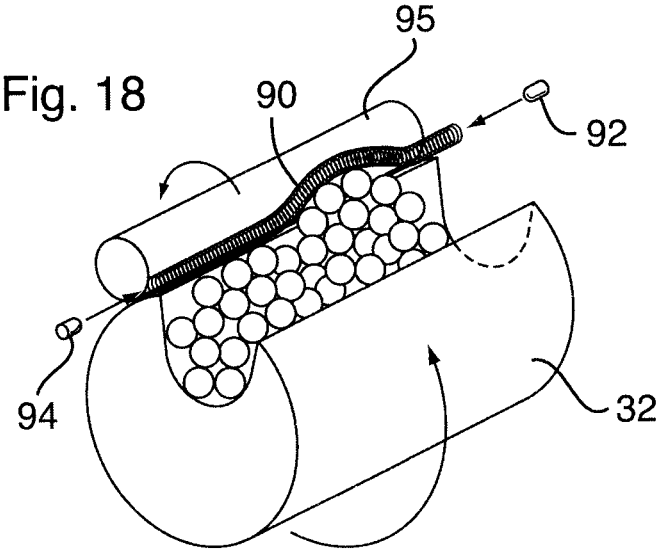
FIG. 18 is a perspective view of the dispensing drum showing the operation of a product jam sensor.
Figure 19:
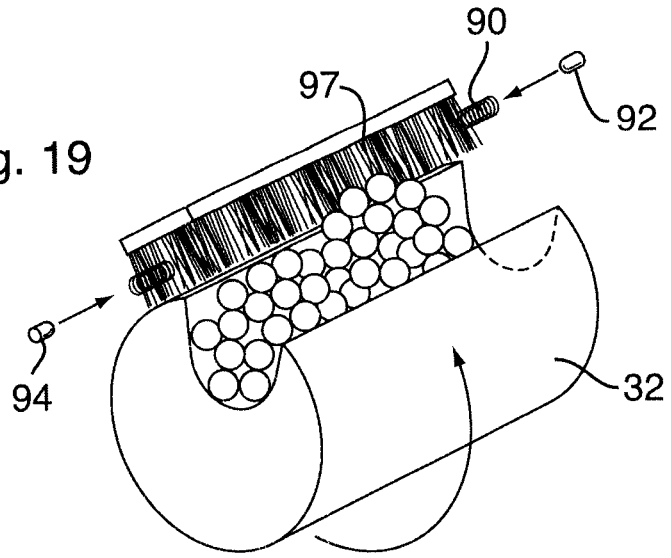
FIG. 19 is a perspective view of the dispensing drum showing the optional sensor with a skimmer brush.

During a dispensing cycle, the drum 32 rotates in a forward (dispensing) direction as long as the receiver 94 detects light from the LED 92. If the spring 90 is deflected by articles 2 protruding from the dispensing slot 34 to the point that the spring 90 deflects and breaks the beam of light from the LED 92 to the receiver 94, for example as shown in FIG. 18, the vending machine control software reverses the direction of the drum 34 through a small predetermined arc of rotation, for example 30 degrees, and then resumes driving the drum 32 forward. By virtue of this reciprocating motion, when the forward motion of the drum 32 resumes, articles 2 either will have settled into the dispensing slot 34 or will be caught by ejection roller 95, which is driven in the same direction as the drum 32 via gears 96, and ejected back into the product bin 22. This process repeats until no articles are protruding from the slot 34, reducing opportunities for crushing or otherwise deforming articles 2 during the dispensing cycle. The sensor-based reciprocation of the dispensing drum 32 also has the effect of ensuring that articles 2 from the product bin 22 properly settle into the slot 34, so that the intended metered amount of product (as determined by the size of the articles 2 and the volume of the slot 34) is consistently delivered to the purchaser. In an alternate embodiment, the ejection roller 95 may be replaced with a brush 97, as shown in FIG. 19.

The specific bulk vender modules 20 from which product will be dispensed to a purchaser, and the amount of product dispensed from the venders 20 with each purchase, are determined by information input into the control panel interface 60 by the purchaser. Each selected vender 20 will be engaged through one or more dispensing cycles, in accordance with the purchaser's selection, and will dispense the purchased product into a single container in the manner described below.

Figure 9:
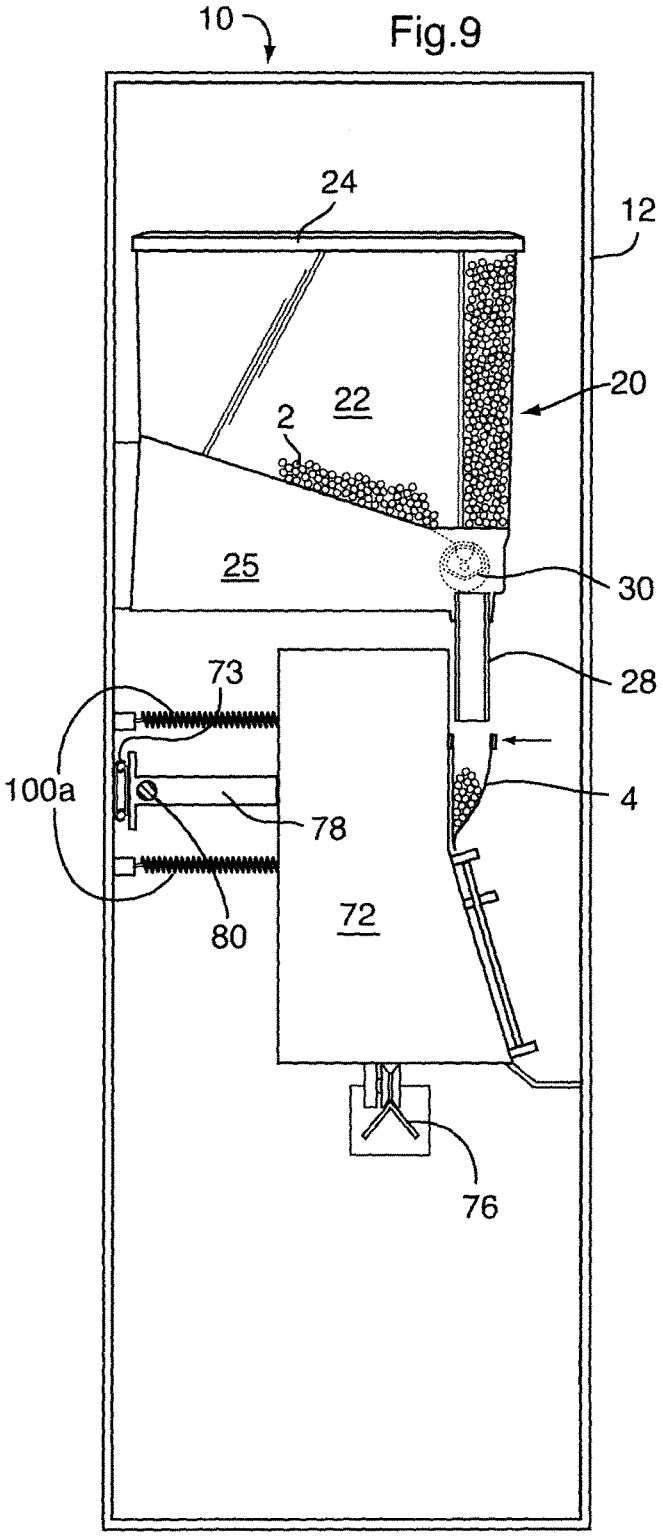
FIG. 9 is a side elevation of the vending machine of FIG. 2 showing a bulk vender module filling a bag with product.

An exemplary embodiment of a bagging system 70 is illustrated in FIGS. 20 to 36. The bagging system comprises a shuttle 72 having rollers 74 supported on a runner bar 76 mounted to the back wall 12*a* of the housing 12. The runner bar 76 may have the profile of an inverted 'V', the rollers 74 being provided with a complementary profile as shown to prevent transverse displacement of the rollers 74, and thus maintain the rollers 74 on the runner 76. The shuttle 72 is supported against tilting by a transport member 78 disposed in a track 73 affixed along the back wall 12 of the housing 12 behind the shuttle 70, as shown in FIG. 9.

In an embodiment shown, a shuttle transport spindle 80 having a helical thread and driven by a shuttle drive motor 82, via a belt drive 84 or any other suitable drive means, is mounted to the back 12*a* of the housing 12. The shuttle transport spindle 80 extends through a complementary threaded bore in the transport member 78 projecting rearwardly from the shuttle 72, such that rotation of the spindle 80 in one direction or the other causes the shuttle 72 to move in a corresponding lateral direction beneath the bulk vender bins 20. The transport spindle 80 thus both maintains the upright orientation of the shuttle 72 and drives the shuttle 72 back and forth between the various venders 20, according to a sequence controlled by the vending machine processor (not shown). The shuttle drive motor 82 is thus activated and controlled by the processor to drive the transport spindle 80 in the appropriate direction to a position beneath a selected bulk vender module 20 responsive to control signals issued by the processor, which in turn correspond to purchase requests input by the purchaser into the control panel interface 60. Control signals are transmitted and power is supplied to the shuttle 72 over a flexible cable 75 (shown in FIG. 2), which may for convenience be housed in a rollable segmented cable carrier such as an IGUS™ Easy Chain™ cable carrier from Igus Inc., to avoid impeding the motion of the shuttle 72 and eliminate tangling of the cable 75 when the shuttle 72 is in motion.

The control panel interface 60 is thus connected to the control processor in conventional fashion, such that when the purchaser touches the control panel interface 60, the processor receives signals representing one or more metered amounts of product to be dispensed from one or more of the plurality of bulk vender modules 20. The processor drives the shuttle transport spindle 80 in the appropriate direction and through the number of rotations required to position the shuttle 72 beneath each selected bulk vender module 20, in a sequence determined by the processor software, so that the metered amounts of bulk product will be dispensed from each vender 20 into the bag 4. The processor and associated software (or firmware) for accomplishing this is well known to those skilled in the art.

Figure 32:
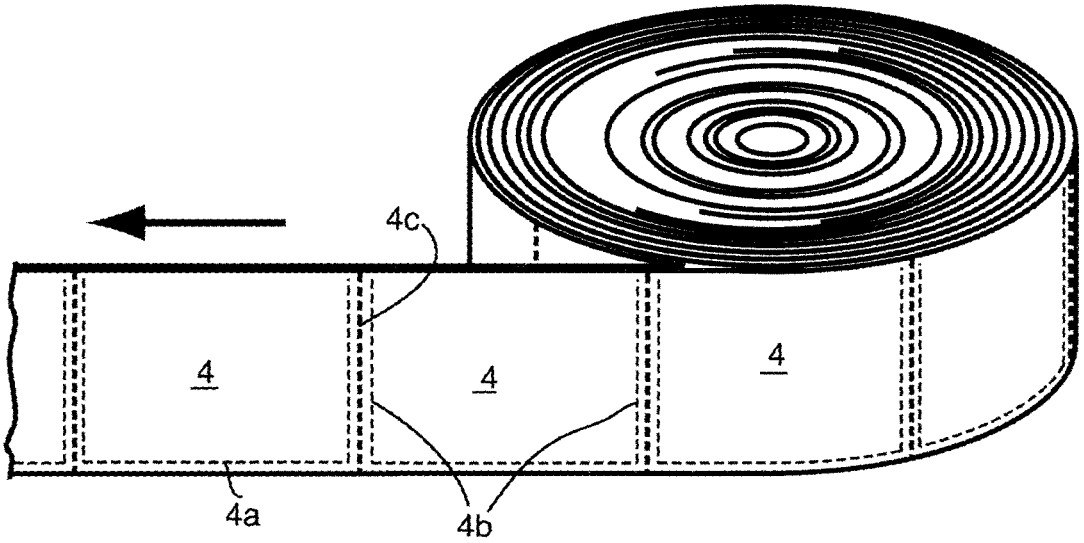
FIG. 32 is perspective view of a roll of bags for the bagging system of FIG. 20.

At any suitable time, for example at the beginning of a dispensing sequence, a bag 4 is loaded onto the shuttle 72. The shuttle 72 receives a bag 4 from a bag dispensing system comprising a bag reel 6 carrying a roll of bags 4. Conventionally, each bag 4 in the roll comprises a double-walled cellophane (or other plastic) sheet, the sheet being either folded or fused along a bottom seam 4*a* to form a closed bottom. The roll of bags 4 has transverse seams 4*b* where the opposed walls of the roll are adhered or fused together to form closed sides of each bag 4, and transverse score lines 4*c* between adjacent side seams 4*b*, as best shown in FIG. 32, for separating one of the plurality of bags 4 from the roll as the bag 4 is loaded onto the shuttle 72 in the manner described below. The tops of the bags 4 between seams 4*b* are detached, thus providing each bag 4 with a top opening.

Figure 21:
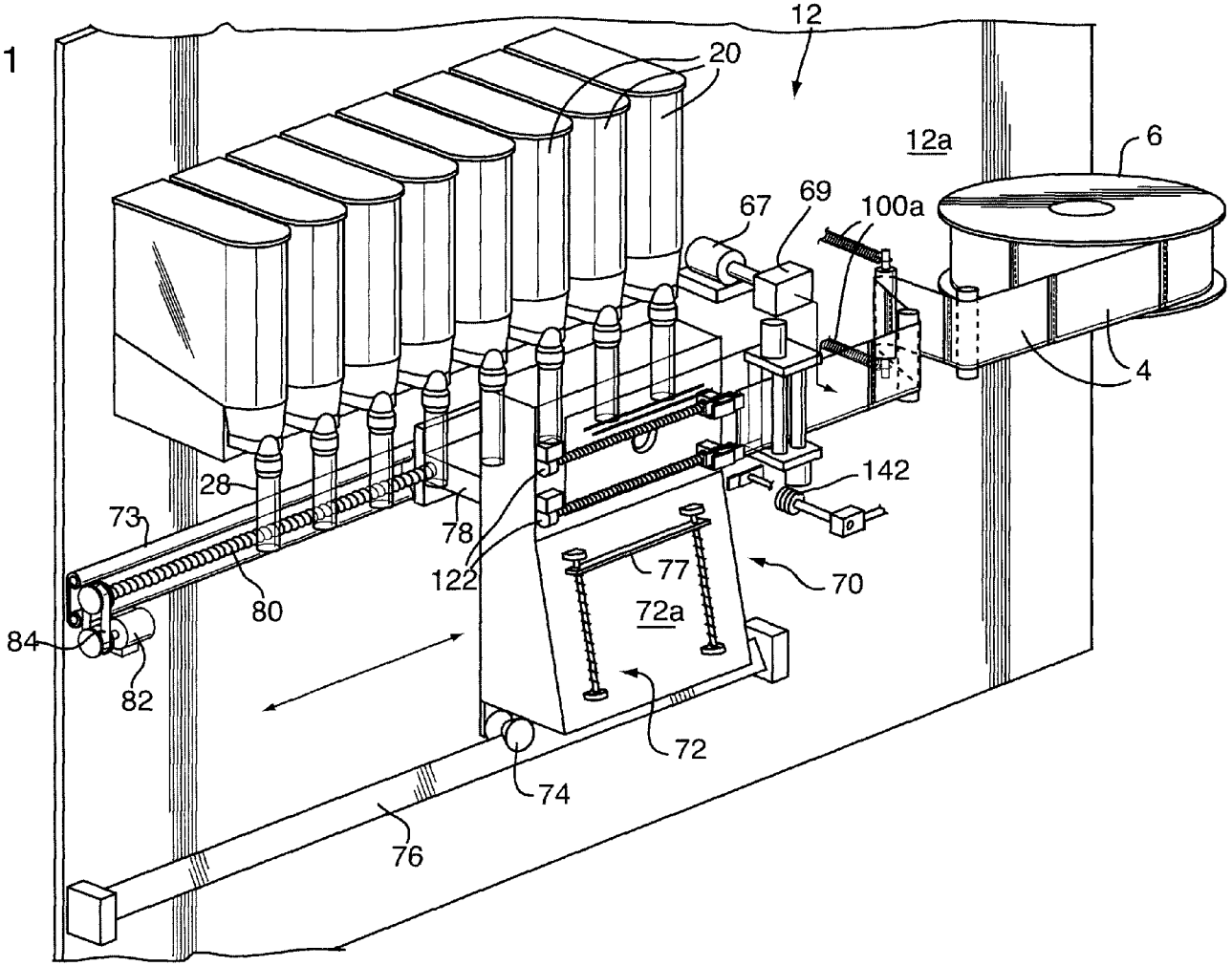
FIG. 21 is a front perspective view of the vending machine of FIG. 20 with the shuttle in a home position.
Figure 22:
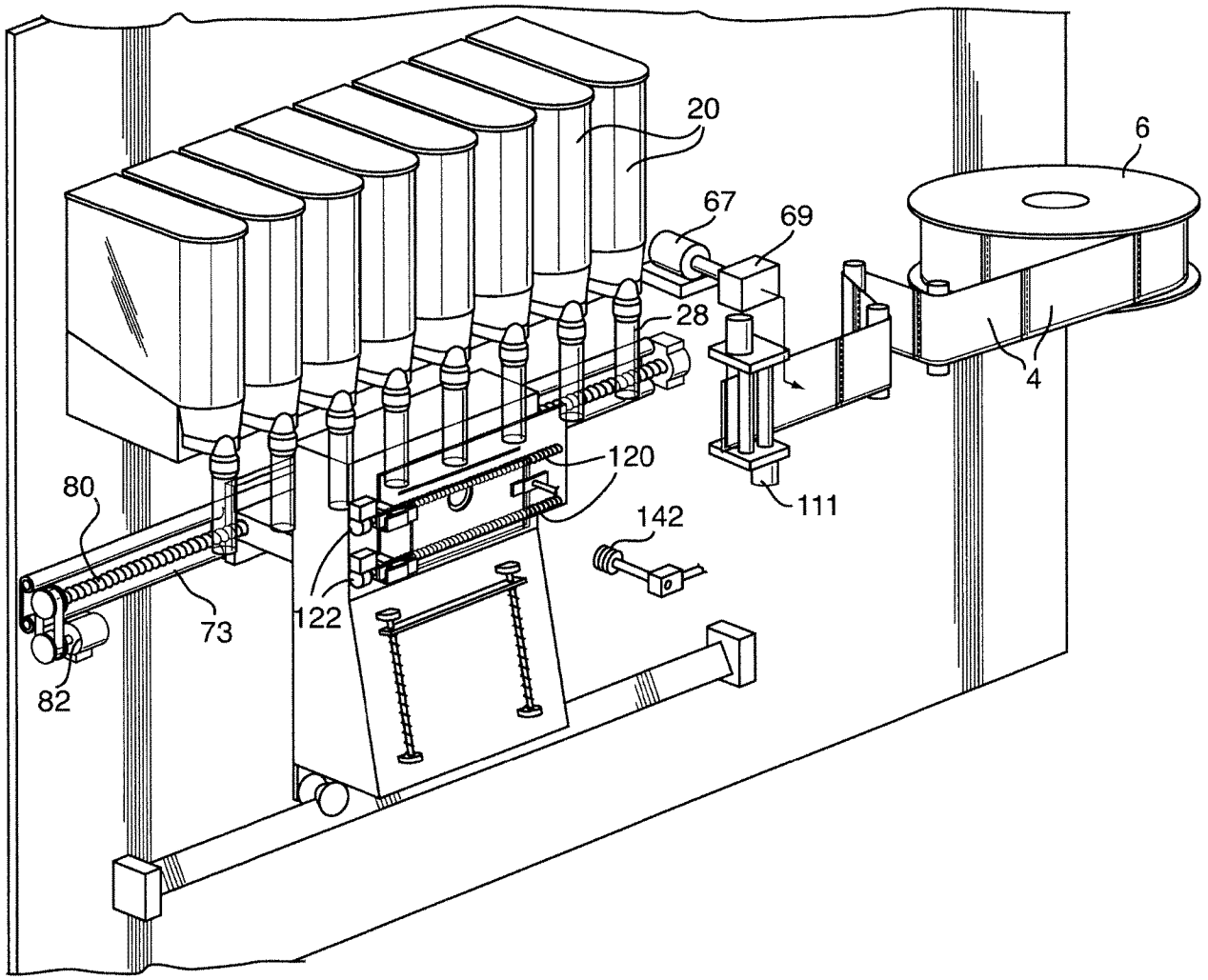
FIG. 22 is a front perspective view of the bagging system of FIG. 20 with the shuttle in a filling position.
Figures 23, 24:
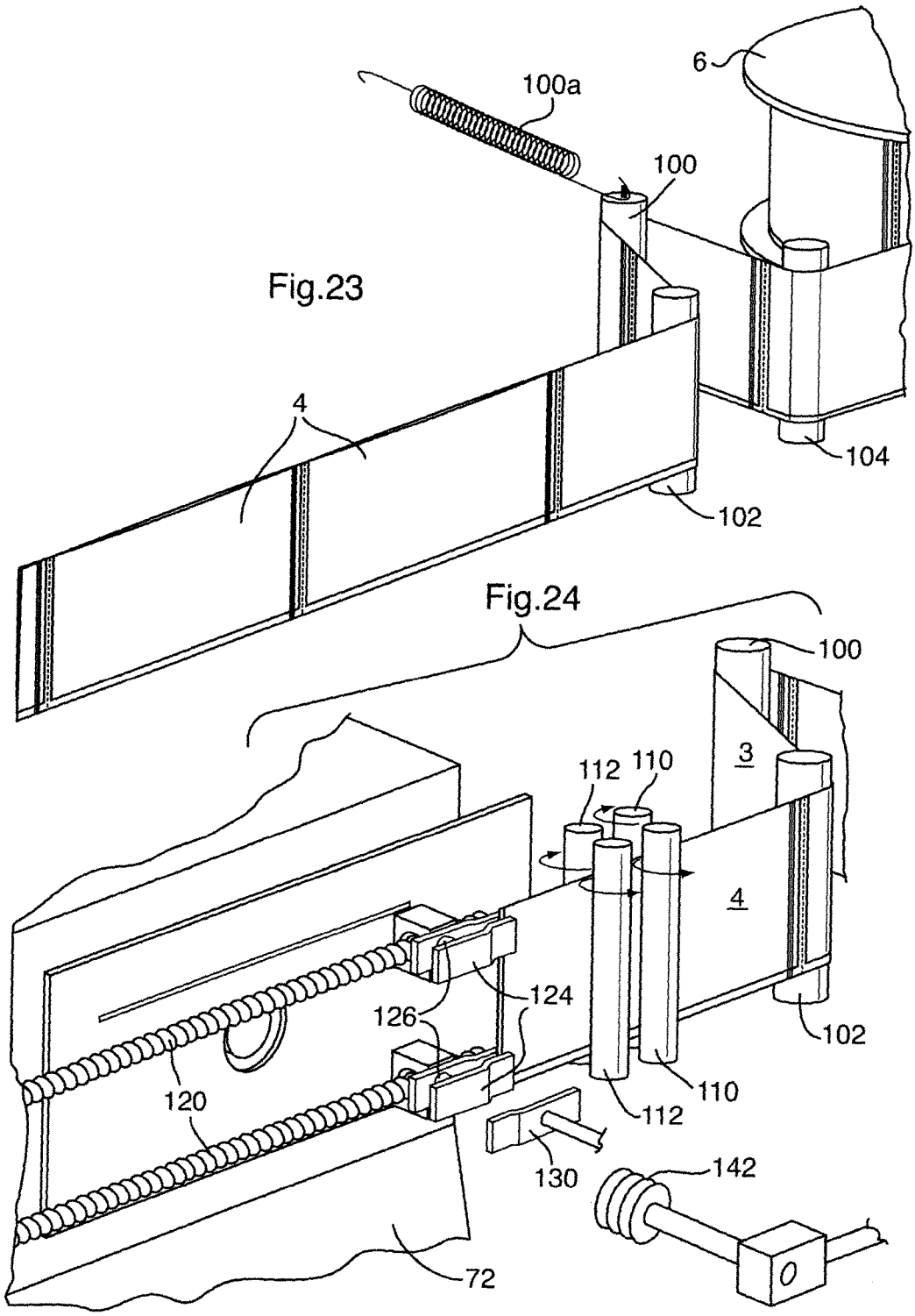
FIG. 23 is a front perspective view of a bag tensioning mechanism in the bagging system of FIG. 20.
FIG. 24 is a front perspective view of the bag loading assembly in the bagging system of FIG. 20 showing the bag in a pre-loaded position.

The roll of bags 4 is loaded onto the bag dispensing reel 6, routed around rollers 102, 104 and tensioning roller 100 as shown in FIG. 23, and tensioned for example by tension springs 100*a* affixed between the rear wall 12*a* of the housing 12 and a shaft of the tensioning roller 100, as shown in FIG. 21, thus drawing tensioning roller 100 toward the back wall 12*a* of the housing 12. The roll of bags 4 is then fed through adjacent pairs of pinch rollers 110, 112, best seen in FIG. 24, driven by pinch roller motors 111, 113 as shown in FIG. 22. Motor 111 drives upstream pinch rollers 110 in opposite directions, and motor 112 drives downstream pinch rollers 112 in opposite directions, such that pinch rollers 110 and pinch rollers 112 are independently controllable. Tension is maintained between the reel 6 and the pinch rollers 110, 112 by tensioning roller 100.

The bag 4 at the free end of the roll is loaded onto the shuttle 72. The shuttle 72 comprises a front face 72*a* supporting upper and lower clamp transport spindles 120, each rotatably anchored to the shuttle 72 at a downstream end and driven by clamp transport spindle motors 122. The clamp transport spindles 120 each have a helical thread and respectively extend through complementary threaded bores in upper and lower bag loading clamps 124. The bag loading clamps 124 are actuated between clamping and open positions by an actuator such as a solenoid or piston 126, biased to the open position, and are driven laterally across the face 72*a* of the shuttle 72 by rotation of the clamp transport spindles 120 via servo motors 122 (best seen in FIG. 22). The bag loading clamps 124 thus clamp onto the leading (downstream) side edge 4*b* of a bag 4 to draw the bag 4 onto the face 72*a* of the shuttle 72, clamping over upper and lower portions of the leading side edge of the bag 4, as shown in FIG. 24. Once the bag loading clamps 124 have secured the bag 4, the pinch rollers 110, 112 rotate in the forward (loading) direction and the bag 4 is loaded onto the face 72*a* of the shuttle 72 by rotation of the clamp transport spindles 120, which draw the bag loading clamps 124 toward the downstream end of the shuttle 72, as shown in FIG. 26.

Figure 25:
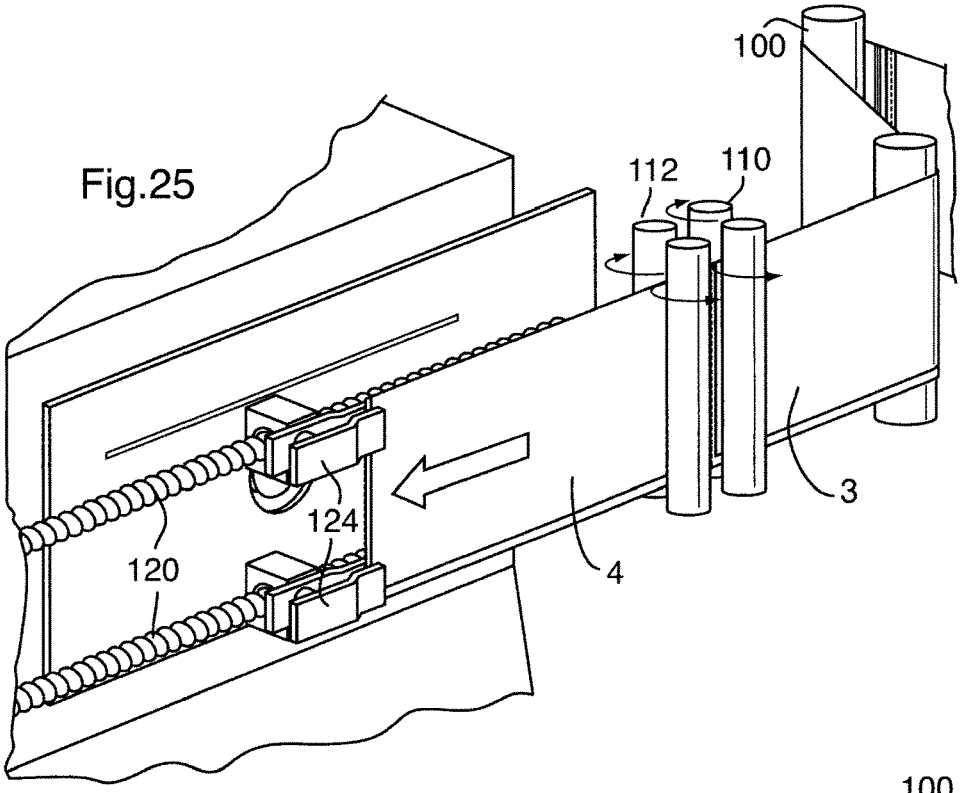
FIG. 25 is a front perspective view of the bag loading assembly in the bagging system of FIG. 20 showing the bag in a partially loaded position.
Figure 26:
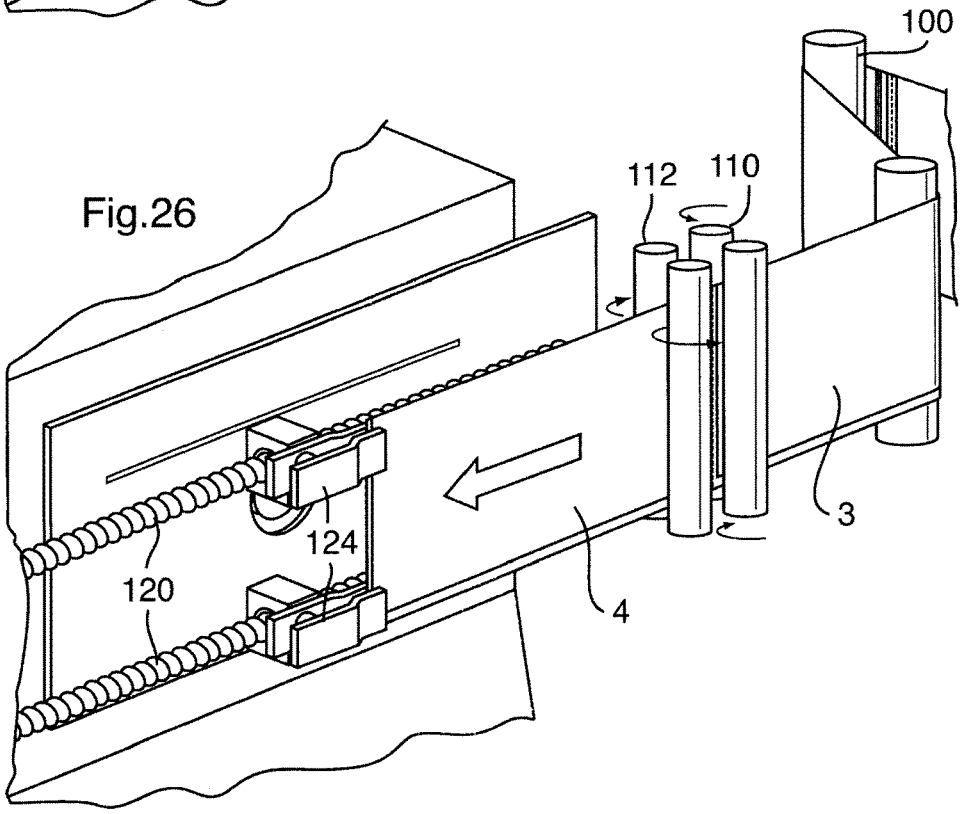
FIG. 26 is a front perspective view of the bag loading assembly in the bagging system of FIG. 20 showing the bag being detached from the bag roll.
Figure 31:
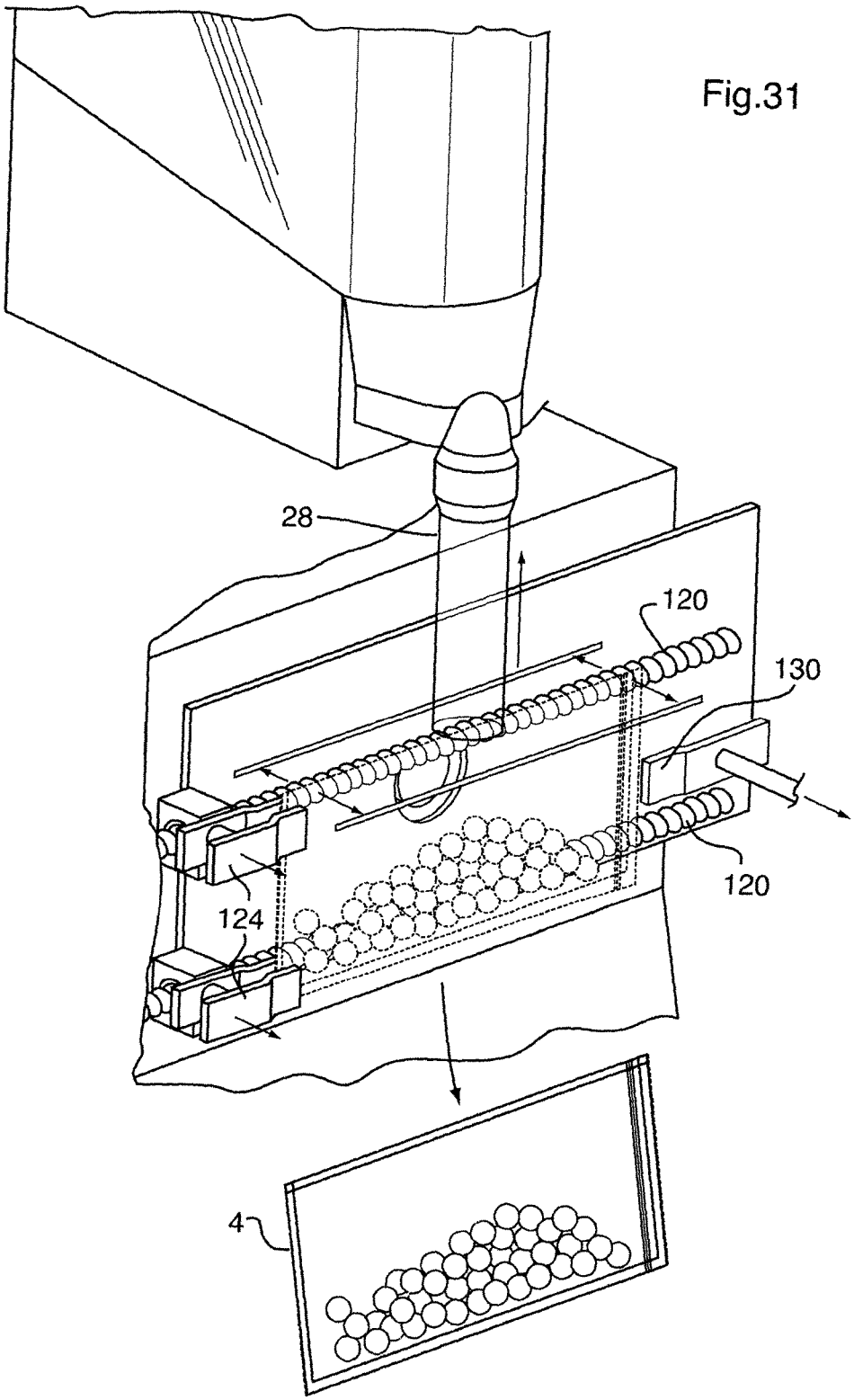
FIG. 31 is a front perspective view of the sealed bag in the bagging system of FIG. 20 being dispensed.
Figure 35A:
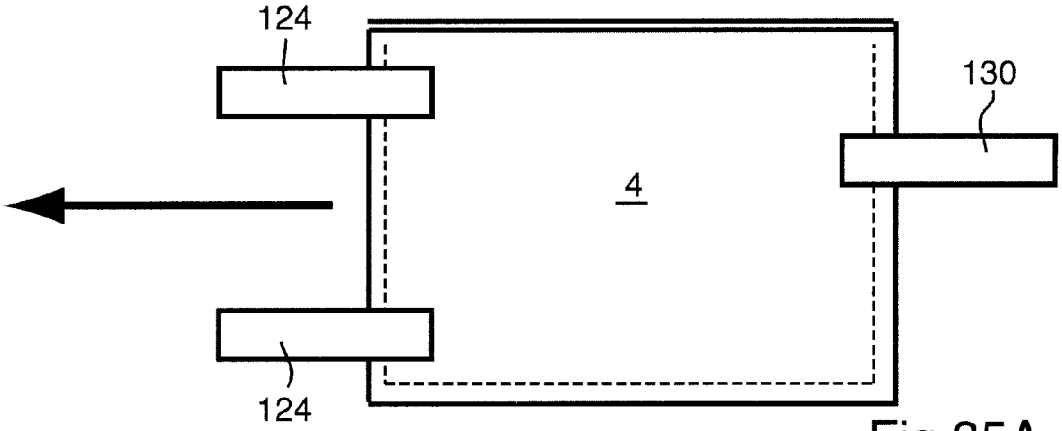
FIGS. 35A to 35C are schematic elevations showing preferred movement of the bag clamps during the bag filling process.

At the position where the score line 4*c* between the bag 4 being loaded and the next upstream bag 3 in the roll reaches the space between the pairs of pinch rollers 110, 112, as shown in FIG. 25, rotation of the upstream pinch rollers 110 is arrested, as shown in FIG. 26. Continued rotation of the downstream pinch rollers 112 detaches the bag 4 being loaded from the next upstream bag 3 in the roll, along the score line 4*c* therebetween. The bag loading clamps 124 continue to draw the bag 4 onto the face 72*a* of the shuttle 72 until the bag loading clamps 124 reach the downstream end of the face 72*a* of the shuttle 72, as shown in FIGS. 27 and 35A.

Once the bag loading clamps 124 have reached the downstream end of the face 72*a* of the shuttle 72, a bag retaining clamp 130 is actuated by an actuator such as a solenoid or piston (not shown) to retain the trailing (upstream) side edge 4*b* of the bag 4 in position against the face 72*a* of the shuttle 72, as shown in FIG. 27.

An actuator such as a solenoid or piston (not shown) then moves bag opening device 140 toward the bag 4 until the suction cup 142 contacts the front panel of the bag 4. The suction cup 142 grabs the front panel of the bag 4, and the suction device 140 is then retracted to open the bag, as shown in FIG. 28. The bag opening process may optionally be assisted by an air burst from an air pulse device (not shown) disposed above the bag 4.

Figure 35B:
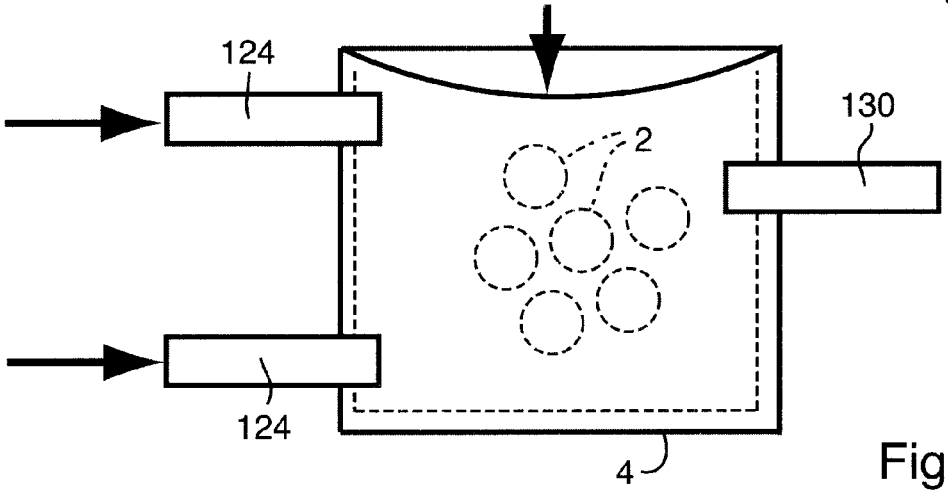
Figure 35C:
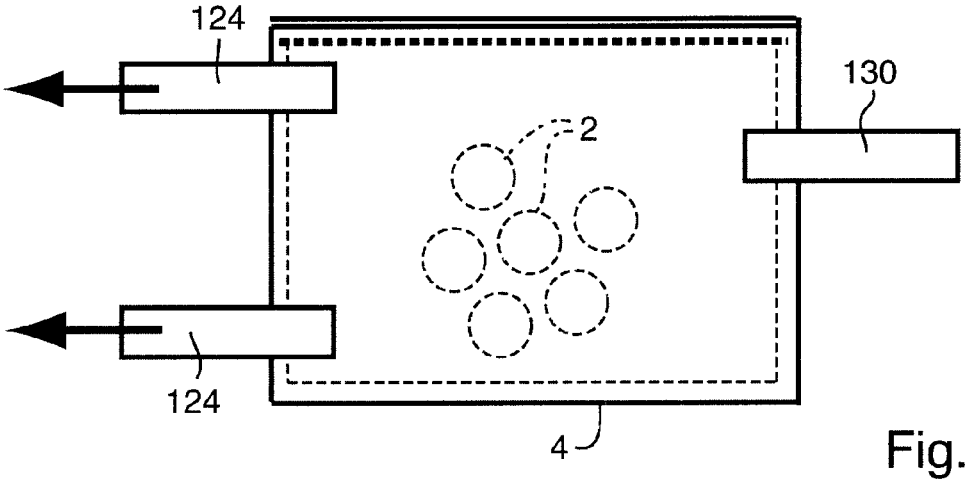

The bag opening process may also or alternatively be assisted by moving the bag loading clamps 124 slightly upstream, as shown in FIG. 35B, reducing the tension on the bag 4 and allowing the front panel of the bag 4 to more readily droop toward an open position for filling. In this embodiment, after filling the bag loading clamps 124 are returned the downstream end of the face 72*a* of the shuttle 72 to stretch the bag 4 for sealing.

In an exemplary embodiment, the product storage bins 22 of bulk vender modules 20 are filled by service personal, by opening the door 16*a* of the housing 12, opening the lid 24 of each product bin 22, pouring the desired product (for example one of a variety of different types of confectionary) into each respective product bin 22, and closing the lid 24. The service person also ensures that a sufficient supply of bags 4 is disposed on the reel 6, and that the free end of the roll of bags 4 is properly fed through fixed rollers 102, 104, the tensioning roller 100 and pinch rollers 110, 112 so that the leading side edge 4*b* of the bag 4 at the free end of the roll protrudes sufficiently to be reached by the bag loading clamps 124. If the type of product is being changed from a product previously stored in a particular vender 20, a label on the vender 20 may be changed to identify the new product, and/or the product identification may be recorded in the processor to be displayed on the control panel interface 60. The service person closes and locks the door 16 of the housing 12.

A purchaser who desires to purchase product selects the bulk vender module 20 (for example by number, product name, image or otherwise), as prompted by the display of the control panel interface 60, by touching the appropriate region of the control panel interface 60. The purchaser can select the same bulk vender module 20 multiple times to purchase a plurality of metered dispensing amounts of the same type of product, and/or other bulk vender modules 20 containing other products sought to be purchased as part of the product mix. When the purchaser is finished selecting (indicated for example by the purchaser touching a particular region of the control panel interface 60 displaying an 'OK' key or another end-of-sequence indicator), the control panel interface 60 displays the amount of money required to pay for the selected product. The user inserts the required amount of coinage into a coin slot 63*a*, or a bill of a sufficient denomination into the bill accepter slot 63*b*, or a card such as a credit card, debit card or gift card into the card reader slot 62, in order to make payment. When the correct amount of money for the selected amount of bulk product has been inserted (or the credit card or debit card payment has been made via card acceptor 62 and authorized), the vending machine dispensing cycle is initiated.

Figure 20:
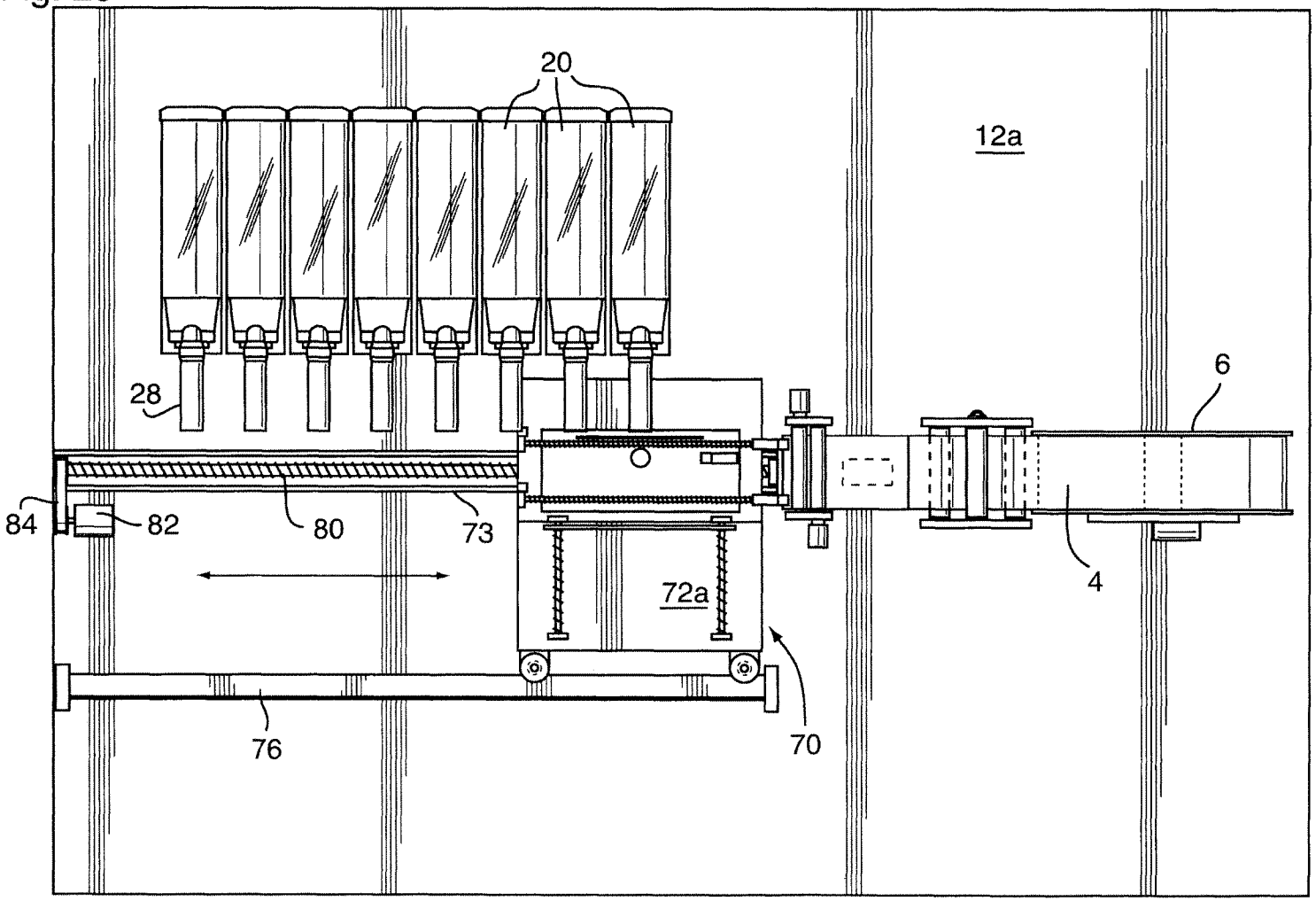
FIG. 20 is a partial front perspective view of a first embodiment of the vending machine showing a dispensing system having a bagging system utilizing a bag roll.

During the dispensing cycle, the processor may generate a vending sequence which loads a bag 4 into the shuttle 2, prints product identifying and/or nutritional information and/or other information or indicia onto the bag 4 (or onto a separate label), opens the bag 4, and then moves the shuttle 72 to a position beneath each selected vender 20 in the processor-generated sequence, and at the end of the dispensing sequence returns the shuttle 72 to the home position shown in FIGS. 20 and 21.

To load the bag 4 onto the shuttle 72, the upstream and downstream pinch rollers 110, 112 are actuated to move the bag 4 downstream until the leading side edge 4*b* of the bag 4 is disposed between the respective jaws of the bag loading clamps 124, which are preferably biased to the open position. The bag loading clamps 124 are then actuated to the clamping position by actuators 126, to clamp the leading side edge 4*b* of the bag 4.

Clamp transport motors 122 are actuated to draw the bag 4 laterally across the face 72*a* of the shuttle 72 by rotation of the clamp transport spindles 120 within the threaded bores extending through the bag loading clamps 124, while the pinch rollers 110, 112 rotate in the forward (loading) direction, paying off the roll of bags as the leading bag 4 is being loaded.

When the score line 4*c* between the bag 4 being loaded and the next upstream bag 3 in the roll passes the upstream pinch rollers 110, as shown in FIG. 25, rotation of the upstream pinch rollers 110 is arrested, as shown in FIG. 26. Continued forward rotation of the downstream pinch rollers 112 detaches the bag 4 being loaded from the next upstream bag 3 in the roll along the score line 4*c*. When the bag 4 being loaded has cleared the pinch rollers 12, rotation of the pinch rollers 112 is arrested. The bag loading clamps 124 continue to draw the bag 4 onto the face 72*a* of the shuttle 72 until the bag loading clamps 124 reach the downstream end of the face 72*a* of the shuttle 72.

Once the bag 4 is fully extended across the front face 72*a* of the shuttle 72, the upstream bag retaining clamp 130 is actuated and depresses the trailing (upstream) side edge 4*b* of the bag 4 against the face 72*a* of the shuttle 72, to retain the bag 4 in position during printing and filling, as shown in FIG. 27. In the embodiment, the processor actuates solenoid 67 and enables the print head 69 (shown in FIG. 21) to print the selected product names (and optionally nutritional and/or other information or indicia) onto the front panel of the loaded bag 4.

When the printing operation is complete, the bag opening device 140 is moved to the bag opening position, with the suction cup 142 contacting the front panel of the bag 4. The suction cup 142 grabs the front panel of the bag 4 and the suction device 140 is retracted to open the bag, as shown in FIG. 28. If desired the bag loading clamps 124 may be moved slightly upstream as the bag opening device 140 is retracted, as shown in FIG. 35B, reducing the tension on the bag 4 and allowing the front panel of the bag 4 to droop forwardly. The loaded bag 4 is then ready to be filled. It will be appreciated that although a suction cup 142 is shown, the bag opening device 140 may instead have air assisted-suction, or alternatively may utilize a releasable adhesive tip or the like to releasably adhere to the front panel of the bag 4.

Once the loaded bag 4 is opened, the processor begins to drive the shuttle 72 in sequence to a position beneath (i.e. in substantially vertical alignment with) each selected bulk vender module 20. The processor drives shuttle drive motor 82, which rotates the shuttle transport spindle 80 as necessary to position the shuttle beneath the first of the bulk vender modules 20 in the vending sequence. Once the shuttle 72 reaches this position, the processor initiates a dispensing cycle of the bulk vender module 20 disposed above the shuttle 72 (and thus above the opening of the bag 4).

The processor starts dispensing drive motor 50 to rotate the driveshaft 52 through the required number of rotations to dispense the selected amount of bulk product from the bin 20. For example, the drum gear 38, and thus the drum 32, rotates through one full rotation with each dispensing cycle. With each dispensing cycle, the predetermined metered amount of bulk product in the product bin 22 is captured in the dispensing slot 34 as shown in FIG. 10 and, as the drum 32 continues to rotate, dispensed through the dispensing chute 28 as shown in FIG. 11.

As the drum 32 moves from the home position shown in FIG. 10 toward the dispensing position, the eccentric stud 42 moves to the bottom of its orbital rotation about the shaft 36, lowering the dispensing chute 28 into the bag 4 as shown in FIG. 11 to prevent spillage of product. Similarly, as the drum 32 moves from the dispensing position shown in FIG. 11 toward the home position, the eccentric stud 42 moves along the raceway 39 to the top of its eccentric orbit and thus raises the dispensing chute 28 out of the bag 4, as shown in FIG. 10, providing a clearance for the shuttle 72 to move to the next vender 20 in the vending sequence.

In an exemplary embodiment the drum 32 returns to the home position, illustrated with the dispensing slot 34 in communication with the product in the product bin 22, to end the dispensing cycle for that particular vender 20.

When the processor determines that the first vender 20 in the vending sequence has completed its dispensing cycle, which may be accomplished in any suitable fashion including, without limitation, by monitoring the rotational progress of the dispensing mechanism or receiving a pulse from a limit switch (not shown), the processor moves the shuttle 72 to a position beneath the next bulk vender module 20 in the vending sequence, and the filling process is repeated. For each selected product, once the shuttle 72 is correctly positioned beneath the respective bulk vender module 20 containing that product, the dispensing drive motor 50 associated with that bulk vender module 20 rotates through the required number of rotations to dispense the purchased amount of bulk product into the opening of the bag 4.

The shuttle 72 may be positioned beneath each selected bulk vender module 20 in sequence (i.e. moving in a single direction), or may move back and forth between venders 20 in the order selected by the user or in a random order to increase the "entertainment" provided by the vending sequence (particularly to children). The processor monitors the current position of the shuttle 72, and the transport spindle drive motor 82 rotates the transport spindle 80 through the required number of turns in the required direction in order to reposition the shuttle 72 beneath the next bulk vender module 20 in the sequence. A spring-loaded support bar 77 may be provided on the face 72*a* of the shuttle 72, to assist in supporting the bag 4 as it is being filled.

Once all bulk vender modules 20 have dispensed their respective product as selected by the purchaser into the loaded bag 4, completing the vending sequence, the shuttle 72 returns to its home position and the bag 4 is closed, for example by pressure applied by opposed closing rails 146 against a 'zipper' closure integrated into the top of the bag 4, and thus hermitically seal the bag 4 for dispensing to the purchaser, as shown in FIG. 30, through an opening 17 in the door 16*a* of the housing 12. Alternatively, a fuser may be applied to thermally fuse the bag walls along the top or releasable adhesive or other means may be used to seal the top of the bag 4.

Once the filled bag 4 has been sealed, the shuttle 72 returns to the home position shown in FIG. 21. The filled bag 4 is dispensed by releasing the bag loading clamps 124, allowing the bag to drop off of the shuttle 72 into the purchaser-accessible dispensing opening 17.

Figure 34:
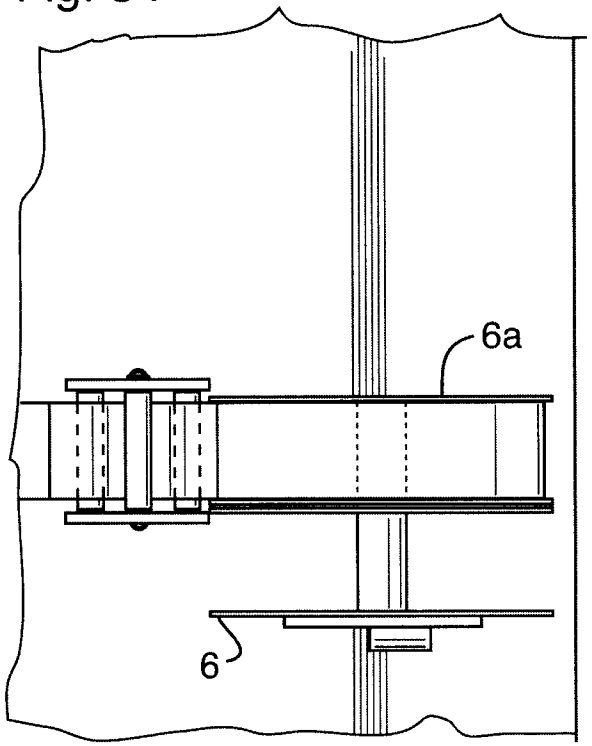
FIG. 34 is a front elevational view of the bag reel replacement system of FIG. 38 showing the empty reel lowered out of the operating position and the filled replacement reel engaged in the operating position.
Figure 33:
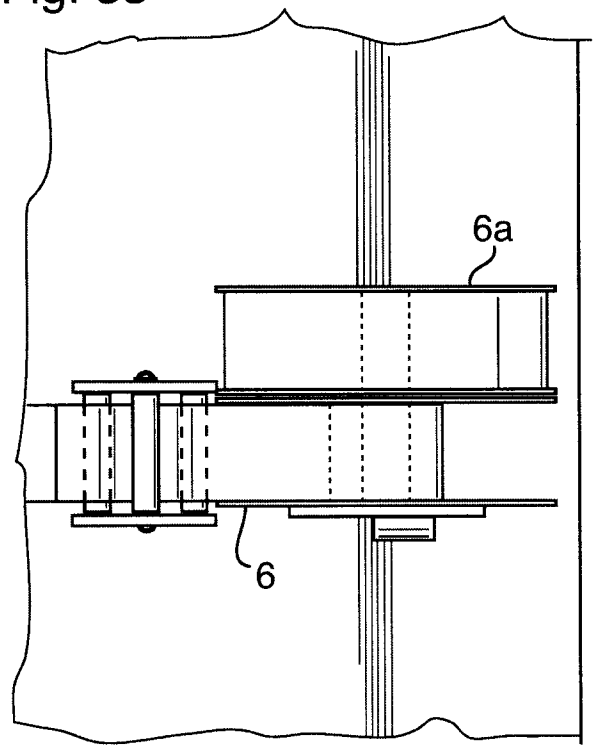
FIG. 33 is a front elevational view of a bag reel replacement system for the bagging system of FIG. 20.

In an exemplary embodiment, shown in FIGS. 33 and 34, a replacement bag reel 6*a* is mounted adjacent to the bag reel 6 and can be dropped into position when the bag reel 6 is depleted.

Figure 36A:
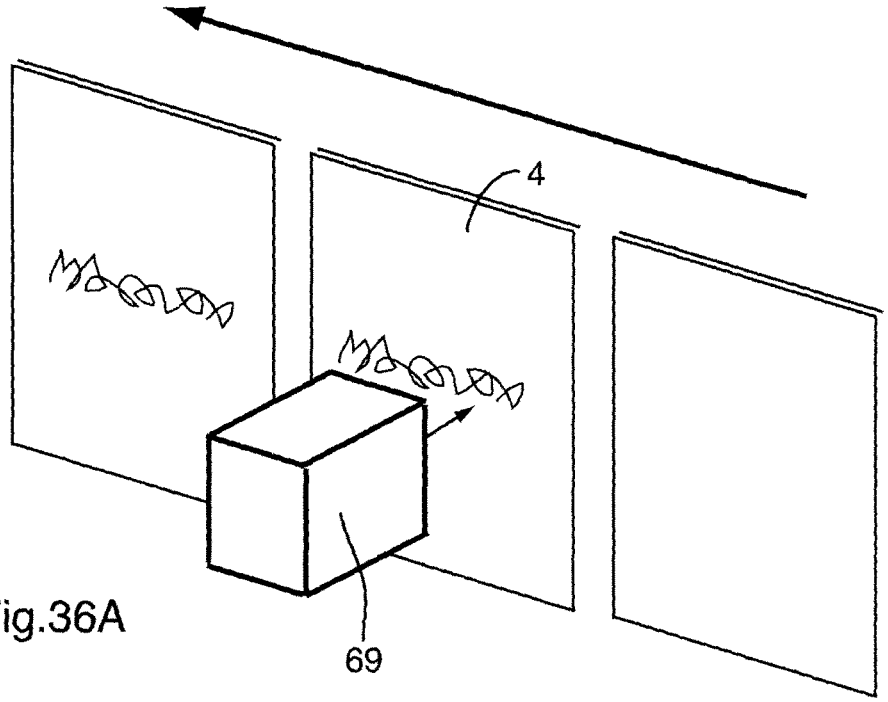
FIG. 36A is a diagrammatic perspective view of information being printed directly onto the wall of a bag.
Figure 36B:
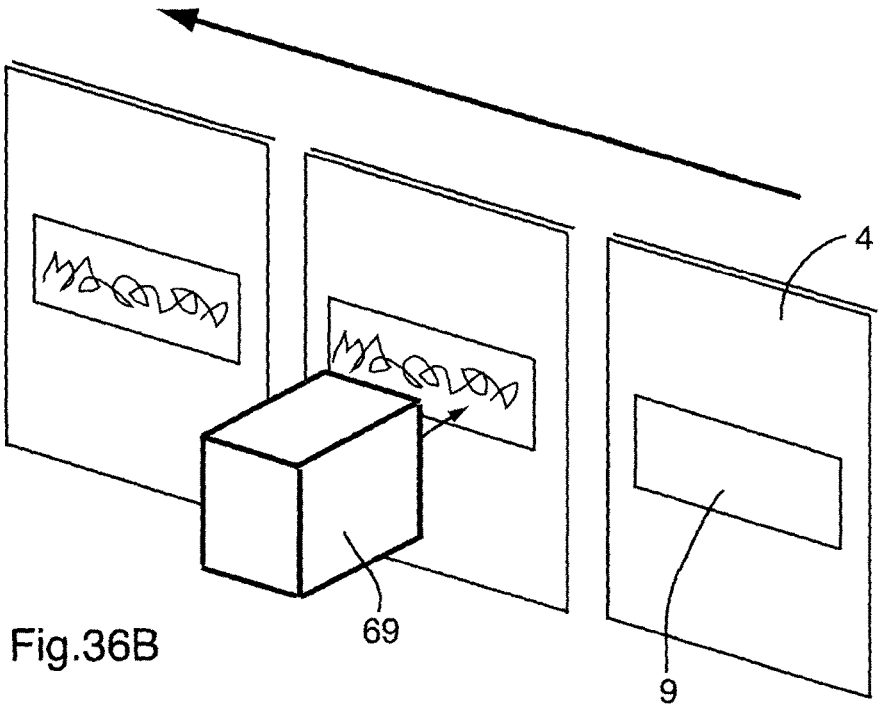
FIG. 36B is a diagrammatic perspective view of information being printed onto a separate label affixed to the wall of a bag.
Figure 36C:
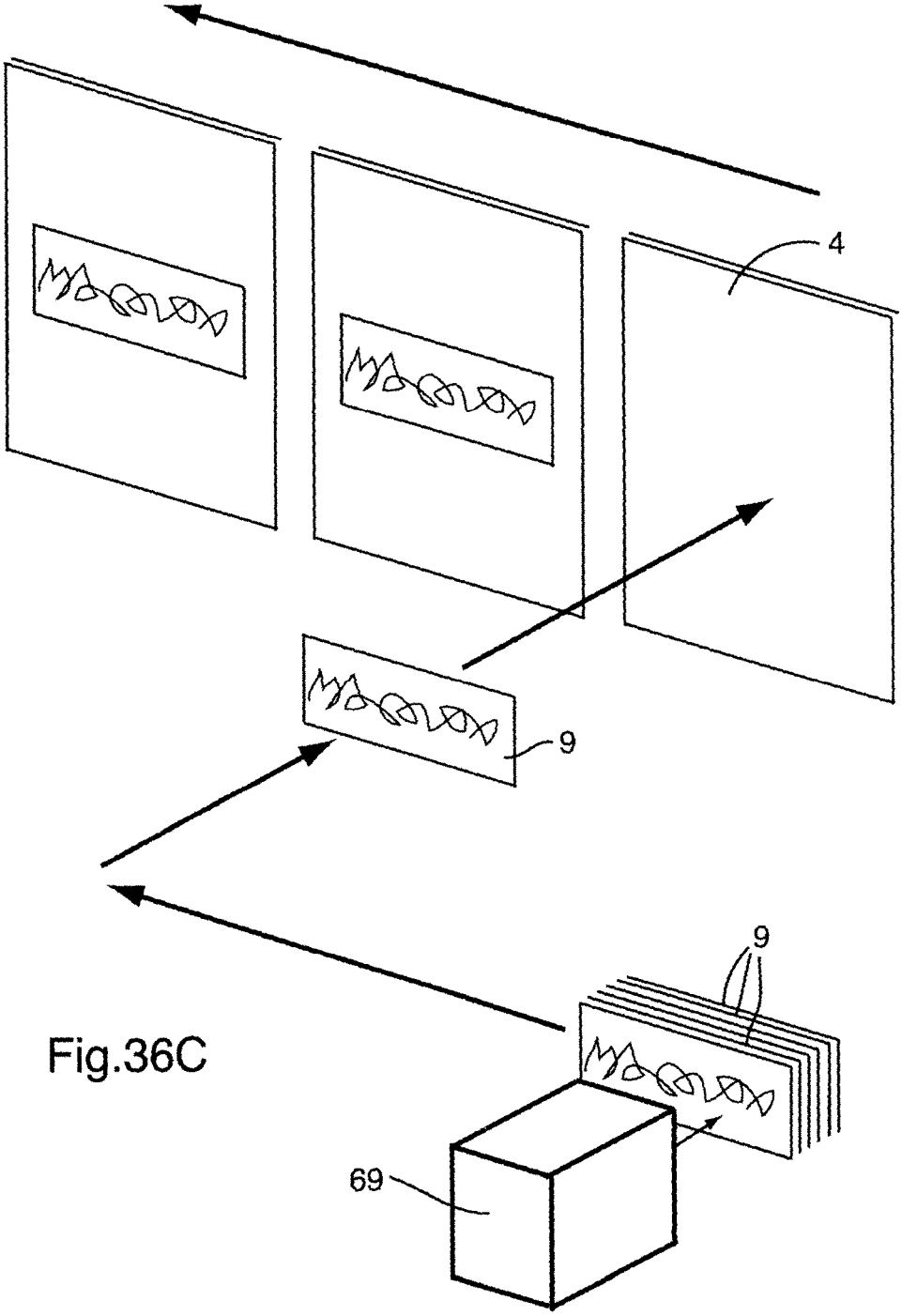
FIG. 36C is a diagrammatic perspective view of information being printed onto a label for subsequently affixing to the wall of a bag.

As the user enters selections into the control panel interface 60, the selections correspond to indicia stored in the processor memory. The processor comprises a print driver, which tasks the print head 69 to print indicia corresponding to each selection made by the user onto the bag as shown in FIG. 36A (or onto a separate label 9 as shown in FIGS. 36B and 36C). The indicia may merely identify the selected product, or may include additional information about the product including for example (without limitation) nutritional information.

Figure 37:
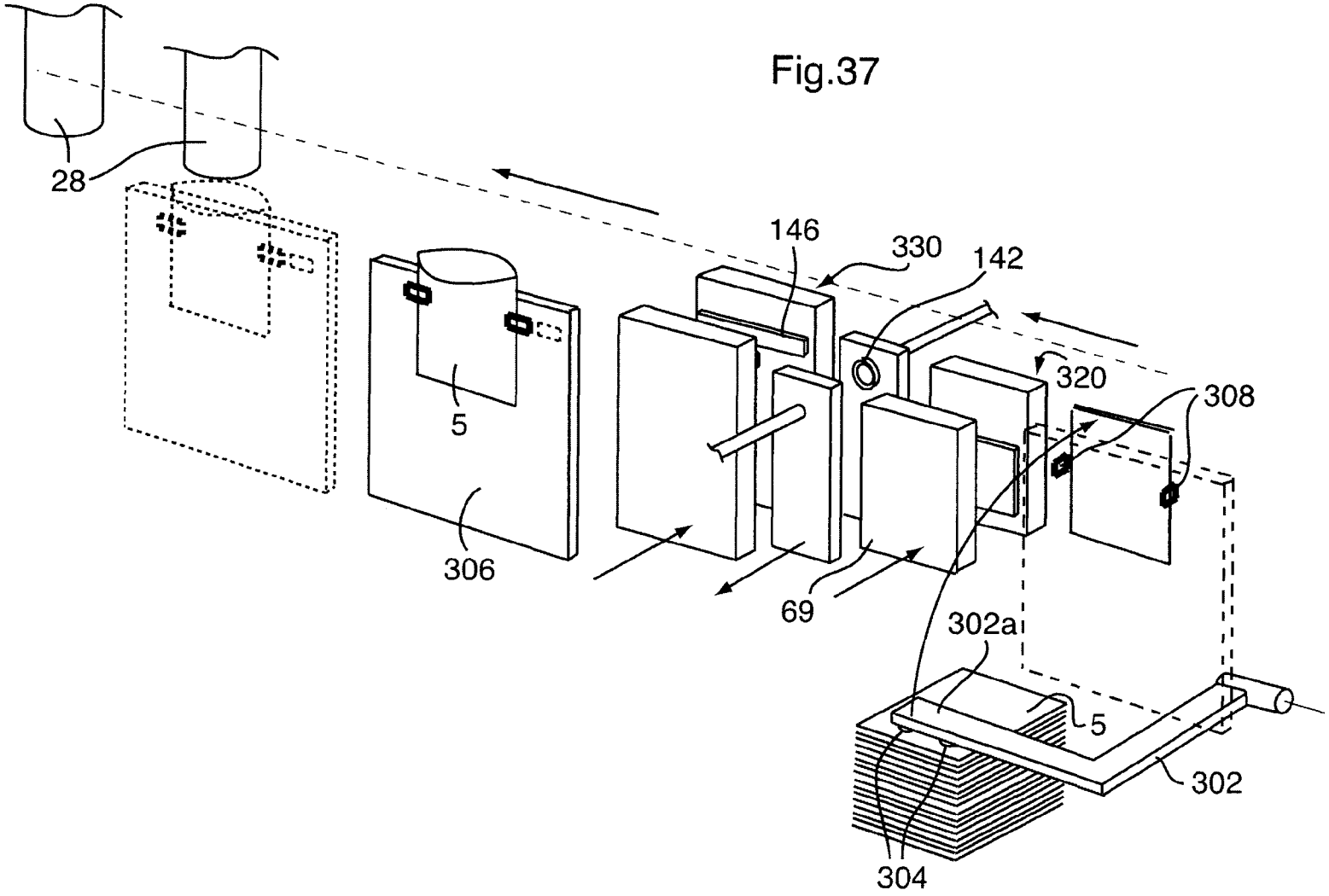
FIG. 37 is a diagrammatic perspective view showing a further embodiment of the bag sealing system utilizing a stack of bags.
Figure 38:
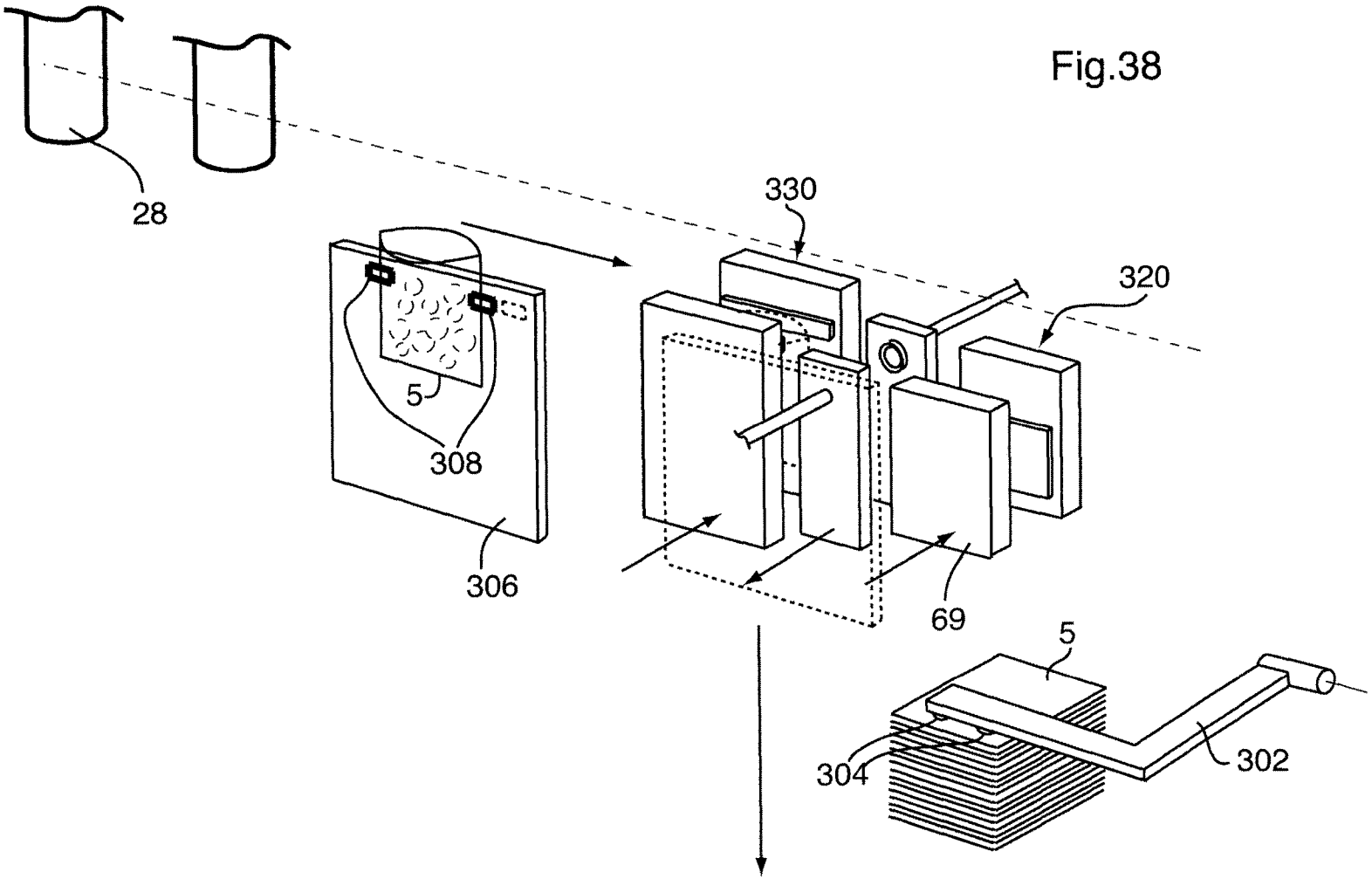
FIG. 38 is a diagrammatic perspective view showing a bag returning to the dispensing position in the bagging system of FIG. 37.
Figure 39:
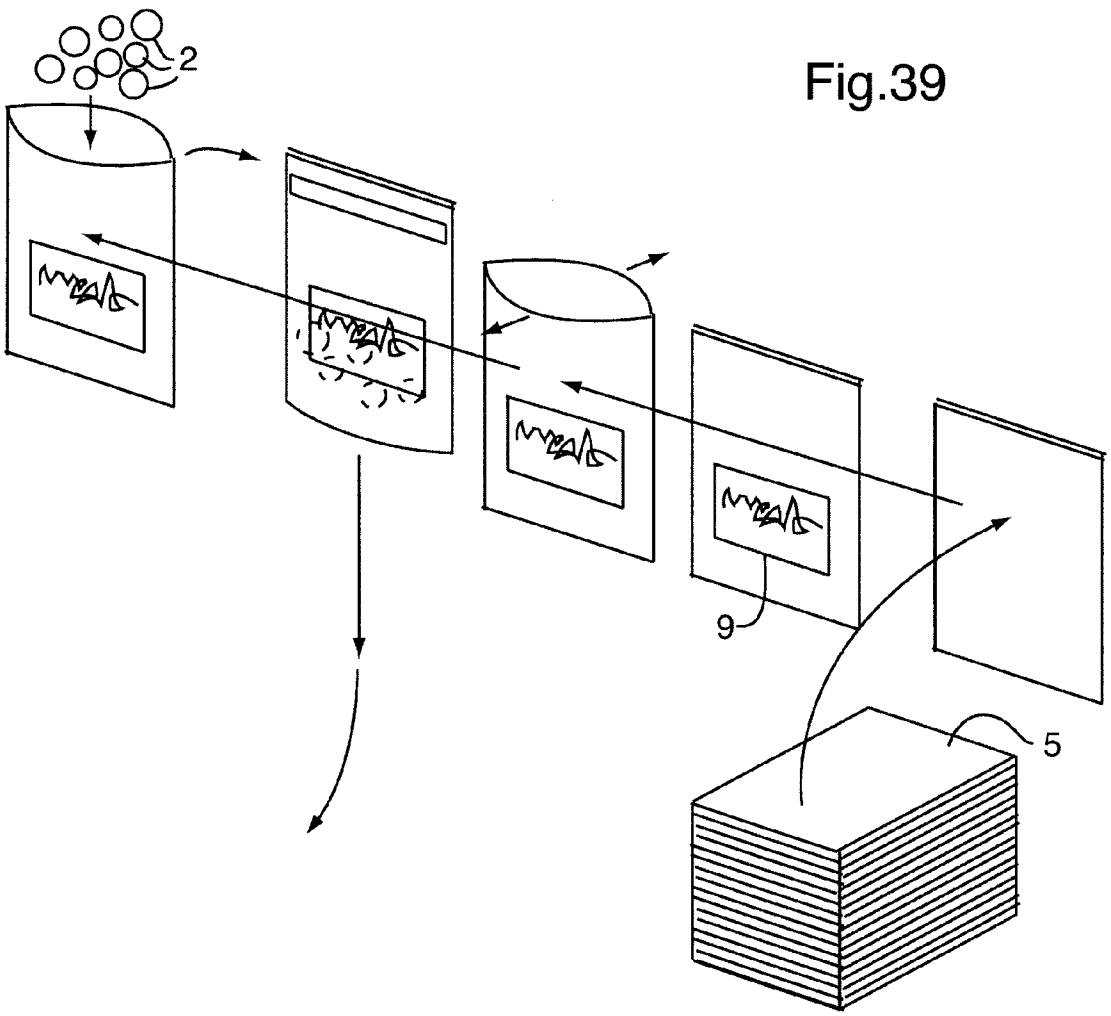
FIG. 39 is a diagrammatic perspective view of a bag during the bagging cycle in the bagging system of FIG. 37.

FIGS. 37 and 38 illustrate a further embodiment of a bagging system 300 for the vending machine (also shown in FIG. 2). An arm 302 pivotally mounted to the housing moves between a lifting position abutting a stack of flexible plastic bags 5, shown in solid lines in FIG. 37, and a loading position loading a bag 5 to the face of the shuttle 306 (shown in phantom lines in the home and dispensing positions in FIG. 37, and shown in solid lines in an intermediate position between the printing and filling stages). The arm 302 comprises a lifting portion 302*a* having releasable attachment elements 304, such as suction cups, for lifting the top bag 5 in the stack. The arm 302 pivots to the loading position, carrying a bag 5 and positioning the bag 5 in the loaded position against the face of the shuttle 306. Clamps 308 are closed to grip the sides of the bag 5 and maintain it in position during the printing, filling and sealing processes. The shuttle 306 travels along a track, such as track 76 illustrated in FIG. 21, through the printing station 320 and bag sealing station 330 and beneath the dispensing chutes 28 of the bulk venders 20. The bag may otherwise be loaded, labelled, opened, filled, sealed and dispensed in the manner described above in connection with the bagging system of FIG. 20.

Figure 3:
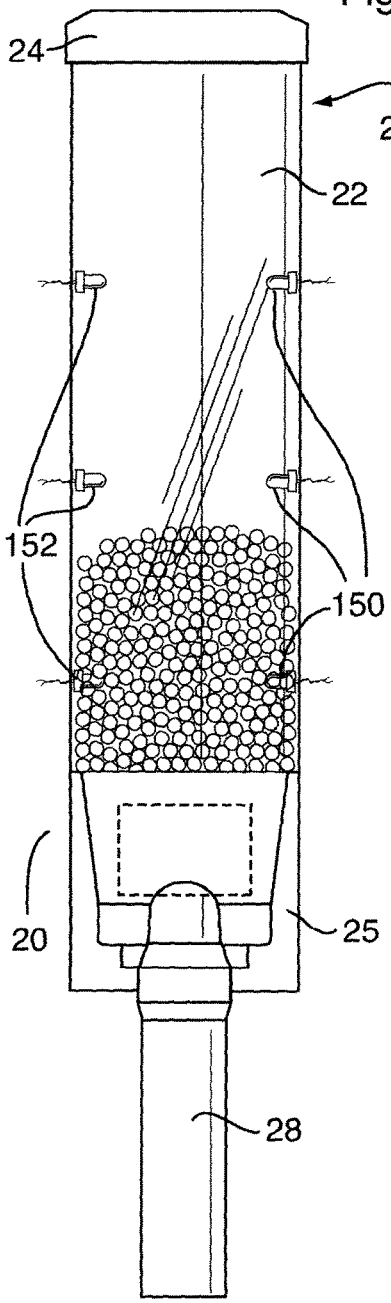
FIG. 3 is a front elevational view of a bulk vender module.

An exemplary embodiment of a depletion detection system is shown in FIG. 3. In this exemplary embodiment, the depletion detection system comprises LEDs 150 disposed in the wall of the product bin 22 across from optical receivers 152 tuned to the specific frequency of the LEDs 150. As items 2 are dispensed and the level of bulk product is reduced, light received by a receiver 152 from the associated LED 150 disposed on the opposite side of the bin 22 signals the processor, indicating the current product level in that product bin 22. The processor may communicate periodically, at preset intervals or following predetermined events, with a remote data processing device, for example a PC, located in the vending machine operator's premises to thus provide a depletion status of the various bulk vender modules 20 in the vending machine 10.

Figure 7:
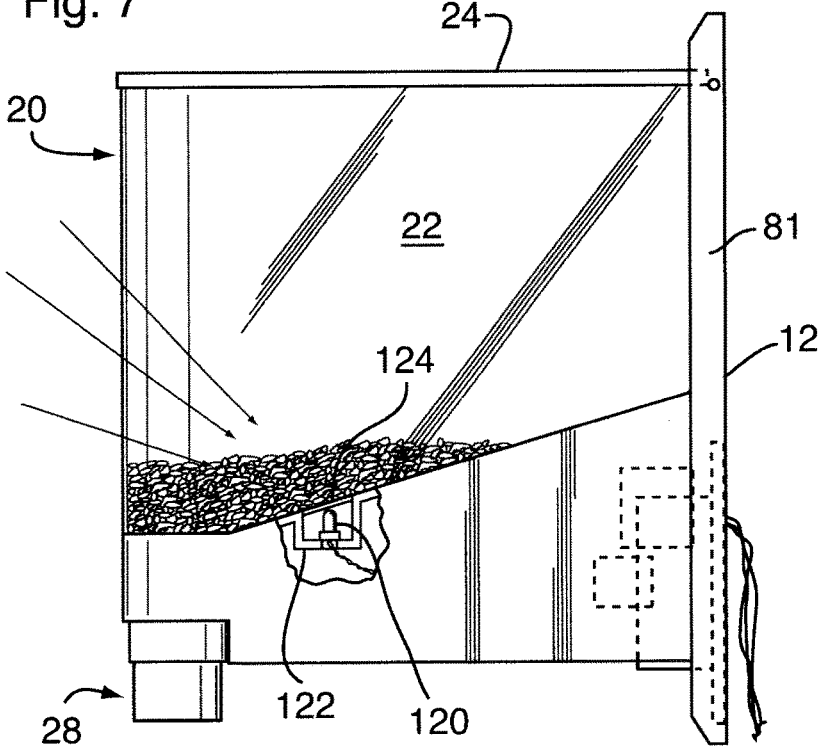
FIGS. 7 and 8 are side elevational views of a further embodiment of a bulk vender module having a product depletion sensor.
Figure 8:
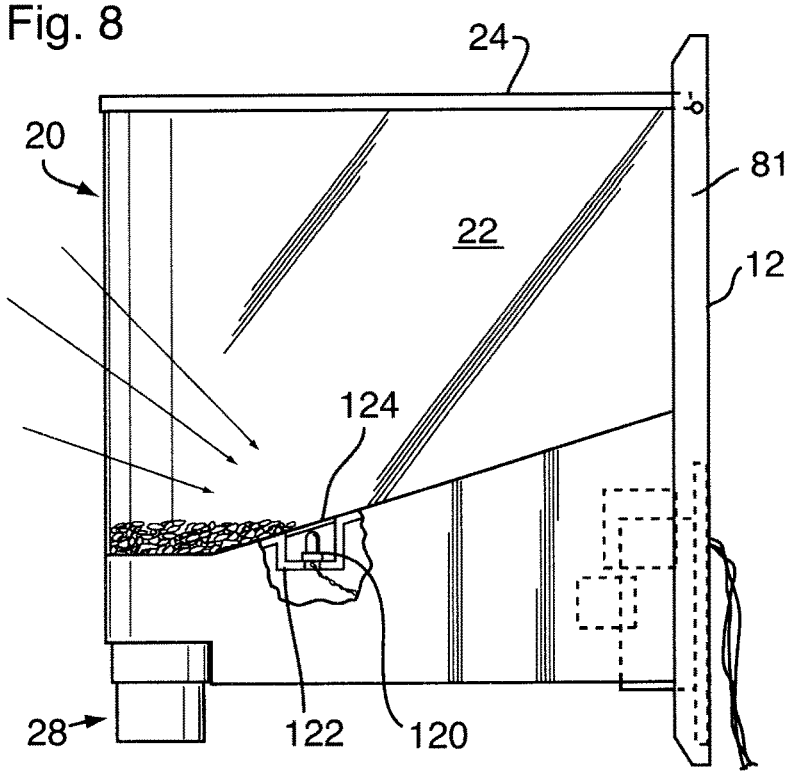

A further exemplary embodiment of a depletion detection system is shown in FIGS. 7 and 8. In this embodiment, the depletion detection system comprises an optical receiver 120 sensitive to ambient light, disposed beneath a small window 124 in the floor 21 of the product bin 22. As items 2 are dispensed and the level of bulk product is reduced, light received by the receiver 120 signals the processor, indicating the current product level in that product bin 22. In this case also the processor may communicate periodically, at preset intervals or following predetermined events, with a remote data processing device, for example a PC, located in the vending machine operator's premises to thus provide a depletion status of the various bulk vender modules 20 in the vending machine 10.

In an exemplary embodiment, the depletion detection system comprising LEDs 150 and optical receivers 152 shown in FIG. 3 can be combined with the depletion detection system comprising an optical receiver 120 sensitive to ambient light shown in FIGS. 7 and 8. In this embodiment, the LEDs 150 and optical receivers 152 can signal the level of depletion of items in the product bin 22, while the optical receiver 120 can signal the controller to disable the particular vending module 20. If a user selects a disabled vending module 20, the video monitor 61 will display a "bin empty" or "bin out of order" message prompting the user to select another bin number or to enter a code for a credit or refund, depending on the method of payment.

FIG. 15 illustrates an exemplary embodiment of a bulk vender module 240 having a rotary turntable-type dispensing wheel. A product bin 242, for example composed of clear plastic, is supported by a base shroud 244 which conceals the drive assembly. Preferably the top of the base 244 (and thus the floor of the product bin 248) is inclined at an angle of approximately 20° toward the front of the vendor unit 240. Disposed near the front of the product bin 242, which is the low portion of the bin floor, is a dispensing wheel 270 seated in a hopper portion 246 of the shroud 244 and covered by a brush housing 272. As is known, the dispensing wheel 270 comprises product compartments 270*a* which are shielded when under the brush housing 272, and as the dispensing wheel 270 is rotated (by rotation of the actuator, for example a motor 50) an empty product compartment 270*a* rotates out from under the brush housing 272 to a position in communication with product stored in the product bin 242. At the same time a product compartment 270*a* initially in communication with product stored in the product bin 242 rotates under the brush housing 272 and comes into alignment with a dispensing opening (not shown) in the floor of the hopper portion 246, which in turn is aligned with the dispensing tube 264 or 266 to dispense product into the dispensing chute 260. A similar rotary dispensing wheel arrangement is described and illustrated in U.S. Pat. No. 4,534,492 to Schwarzli, which is incorporated herein by reference.

In an exemplary embodiment illustrated in FIG. 15, a primary agitator 274 is fixed to a shaft 276 engaged between the brush housing 272 and the lid (not shown) of the vendor module 240. In the embodiment shown, the primary agitator 274 comprises a disk 274*a* having a resilient member, for example a coil spring 274*b*, extending from the disk 274*a* and rotating as the dispensing wheel 270 is rotated, to agitate product within the product bin 242 and avoid clumping or build-up of product around the periphery of the dispensing wheel 270. The primary agitator 274 may be composed of any suitable material, for example zinc or another non-corrosive metal, or from plastic, as desired. The lid 280 is hinged to bracket (not shown) affixed to the back wall 12 of the vending machine 10, and provides a seat (not shown) in which the top end of the shaft 276 rotates when the bulk vendor unit 240 is in operation.

A secondary agitator 278 is disposed along the floor 248 of the product bin 242, toward the rear of the product bin. The secondary agitator 278 shown has a low profile, comprising blades 278*a* extending generally radially from a hub 278*b*, and serves to ensure that product resting on the floor 248 of the product bin 242 is agitated as the dispensing wheel 270 is rotated, and as such moves down the inclined floor 248 of the product bin 242 toward the dispensing wheel 270 each time product is purchased rather than stagnating in the upper portion of the inclined floor 248.

Figure 40:
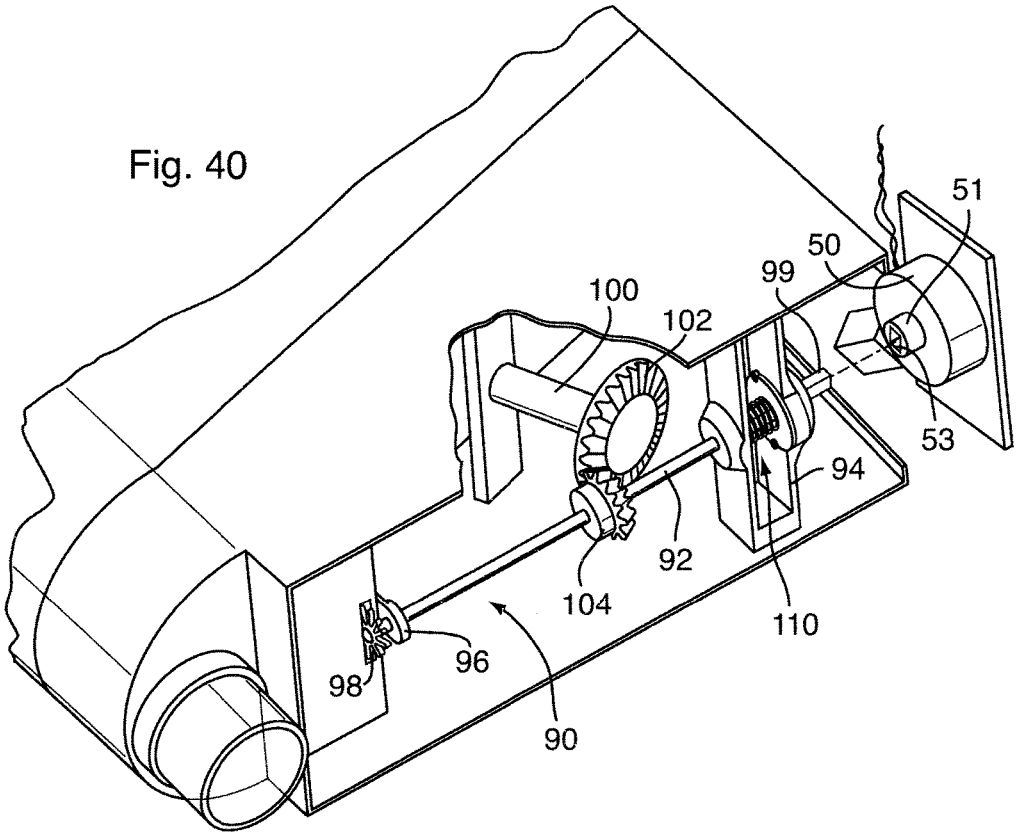
FIG. 40 is a perspective view of a drive mechanism for the bulk vender module of FIG. 15.

The dispensing wheel 270, primary agitator 274 and secondary agitator 278 may be driven by a common drive assembly 290 in the bulk vendor unit 240 shown, as illustrated in FIG. 40. A main drive shaft 292 is mounted through rear and front brackets 294, 296 and able to rotate therein. The front end of the drive shaft 290 is provided with a gear 298 which engages teeth (not shown) on the dispensing wheel 270, for example as described in U.S. Pat. No. 4,534,492 to Schwarzli. The primary agitator shaft 276 is rotationally fixed to the dispensing wheel 270, and thus rotates as the dispensing wheel 270 rotates. The hub 278*b* of the secondary agitator 278 is rotationally fixed to a secondary agitator shaft 300 which terminates within the shroud 244 in a bevel gear 302. A complementary bevel gear 304 attached to the drive shaft 292 at an intermediate portion between the brackets 294, 296 is engaged to the secondary agitator bevel gear 302, and thus rotates the secondary agitator 278 as the drive shaft rotates 292. The rear end of the drive shaft 292 is keyed to the actuator, which in the embodiment shown in electric motor 50 activated by the processor when the user selects the particular bulk vendor unit 240 operated by that respective motor 50, for example by a squared end 299 engaging a complementary square recess 253 formed in a hub 251 driven by the motor 50.

Figure 5:
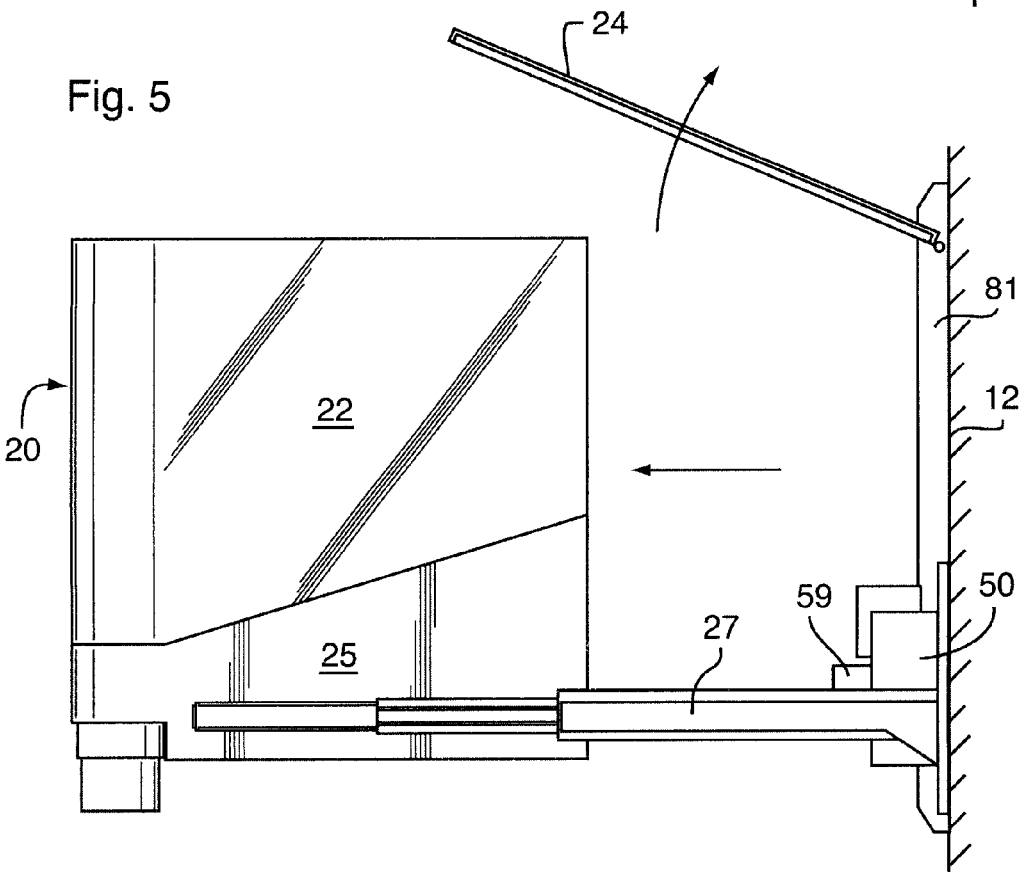
FIG. 5 is a side elevational view of the bulk vender module of FIG. 3 in a servicing position.
Figure 6:
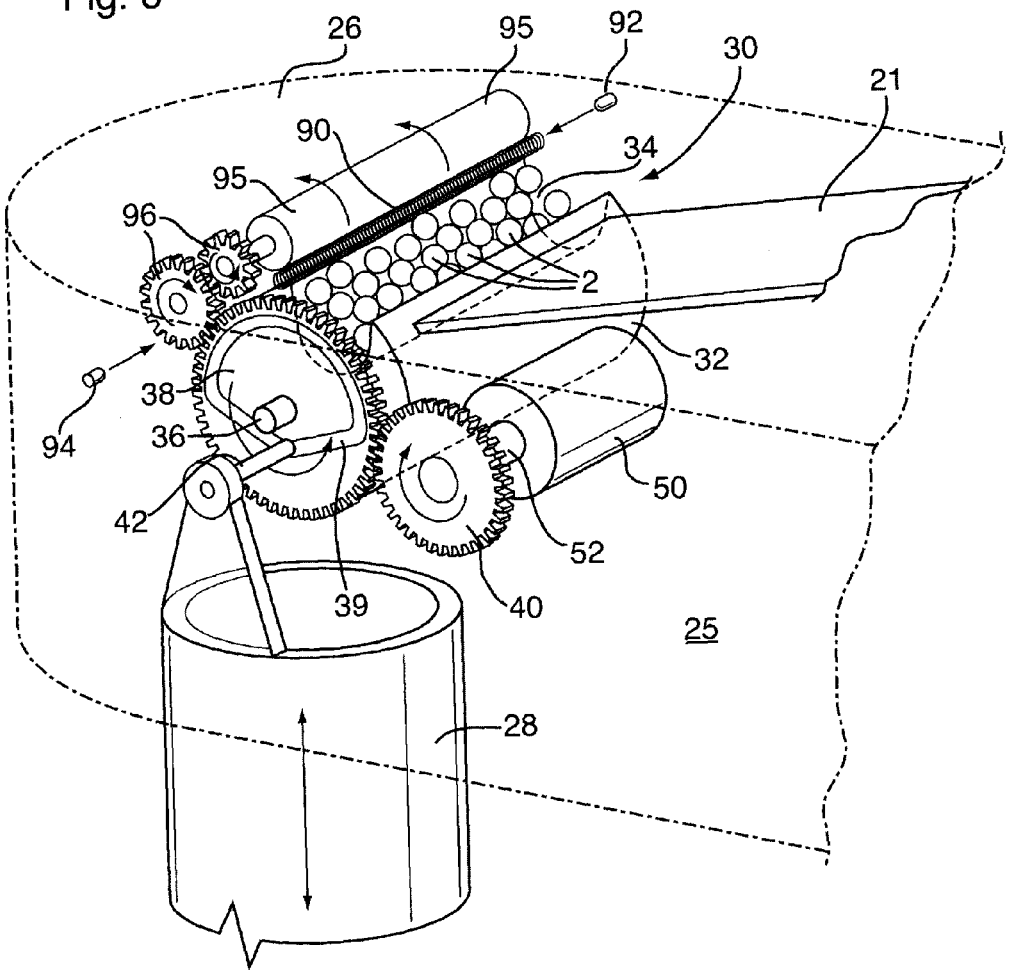
FIG. 6 is a perspective view of a dispensing mechanism in one embodiment of the bulk vender module of FIG. 3.
Figure 41A:
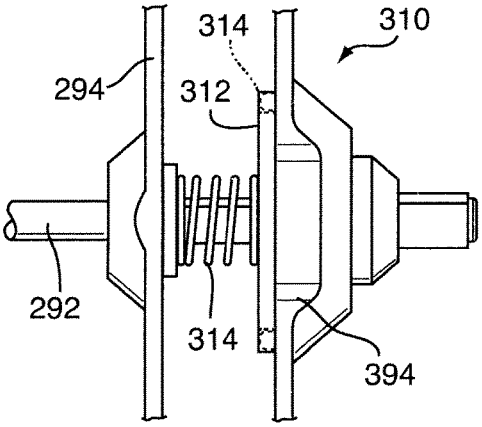
FIG. 41A is a perspective view of a clutch in the drive mechanism of FIG. 40 in an engaged position.
Figure 41B:
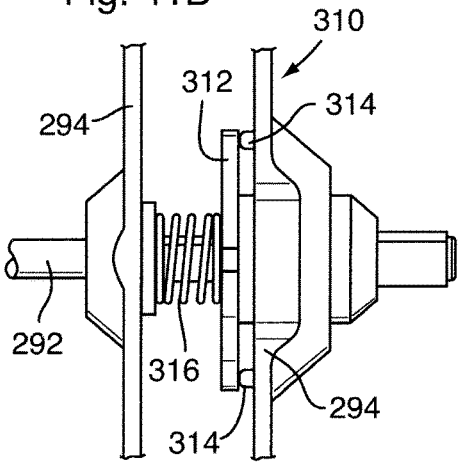
FIG. 41B is a perspective view of the clutch FIG. 41A in a disengaged position.

In other embodiments, the rear end of the drive shaft 292 is provided with a clutch mechanism 310 which locks the drive shaft 292 in specific positions, for example at 90° intervals, when the bulk vendor unit 240 is pulled forward to the servicing position shown in FIG. 5. The clutch mechanism 310, illustrated in FIGS. 41A and 41B, is accommodated within the rear bracket 294. As the bulk vendor unit 240 is pulled away from the back 12 of the vending machine 10, a clutch disk 312 engages projections 314 extending forwardly from the bracket 294 when the drive shaft 292 is in one of the rotational positions in which the projections 314 lock into the clutch disk 312, which correspond to the start/end of each vending cycle. This ensures that when the bulk vending unit 240 is pushed back to the operating position shown in FIG. 4, the squared rear end 299 of the drive shaft 292 has not changed position and thus remains properly aligned with the square recess 253 in the drive hub 51 of the electric motor 50. When the bulk vendor unit 240 is pushed back into the operating position shown in FIG. 4 the clutch spring 316 is depressed, disengaging the clutch wheel 312 from the projections 314 and allowing the drive shaft 292 to freely rotate under the influence of the electric motor 50. As illustrated in FIG. 5, pivoting the lid off of the product bin allows the bulk vendor unit 240 to be pulled to the servicing position, thus engaging the clutch 310 as described above.

Figure 16:
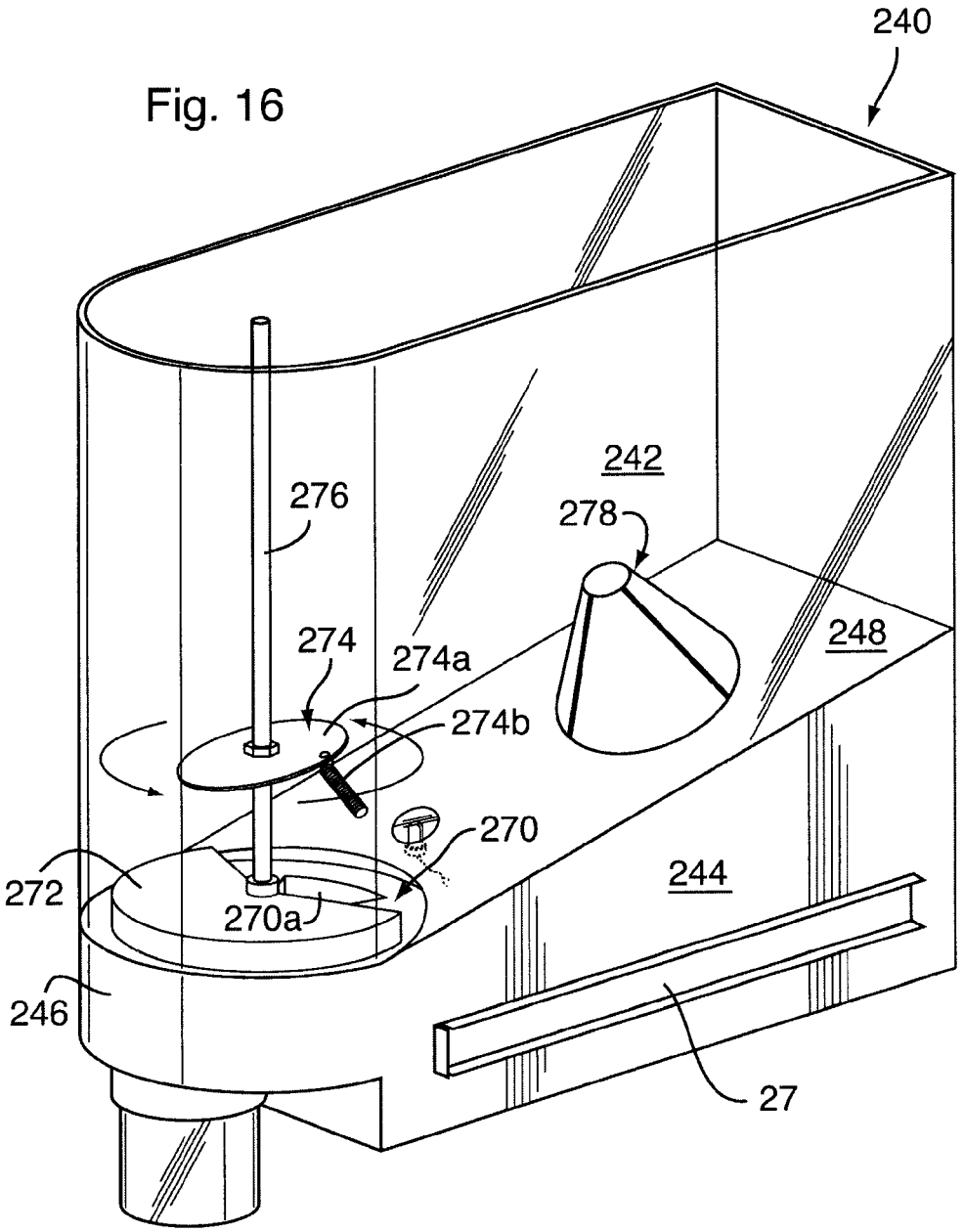
FIG. 16 is a perspective view of an alternate embodiment of a bulk vender module having primary and secondary agitators.
Figure 17:
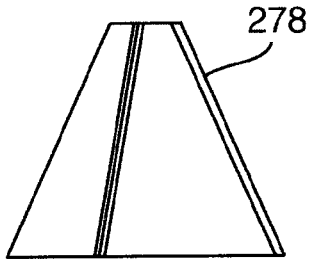
FIG. 17 is a side elevation of the secondary agitator in the bulk vender module of FIG. 16.

FIG. 16 illustrates an alternative exemplary embodiment of the vender module of FIG. 15 in which the secondary agitator comprises a cone-shaped agitator cap 278, shown in FIG. 17. In this embodiment the secondary agitator rotates in the same fashion as in the embodiment of FIG. 15. The agitator cap 278 may be provided with ribs 278*a* as shown, to engage items in the product bin or, depending upon the size and shape of the product being vended, may be provided with resilient members such as coil springs or silicon tubes (not shown) to provide better engagement with items in the product bin 42.

A compartment extending partly or completely down the front of the product bin 42 and isolated from product in the remainder of the product bin 42 by a divider 43 may be filled with product, which makes the product bin 42 look full from the front of the vending machine 10 (and thus more appealing to users) and identifies the specific product contained in that specific bulk vendor unit 40.

Figure 42:
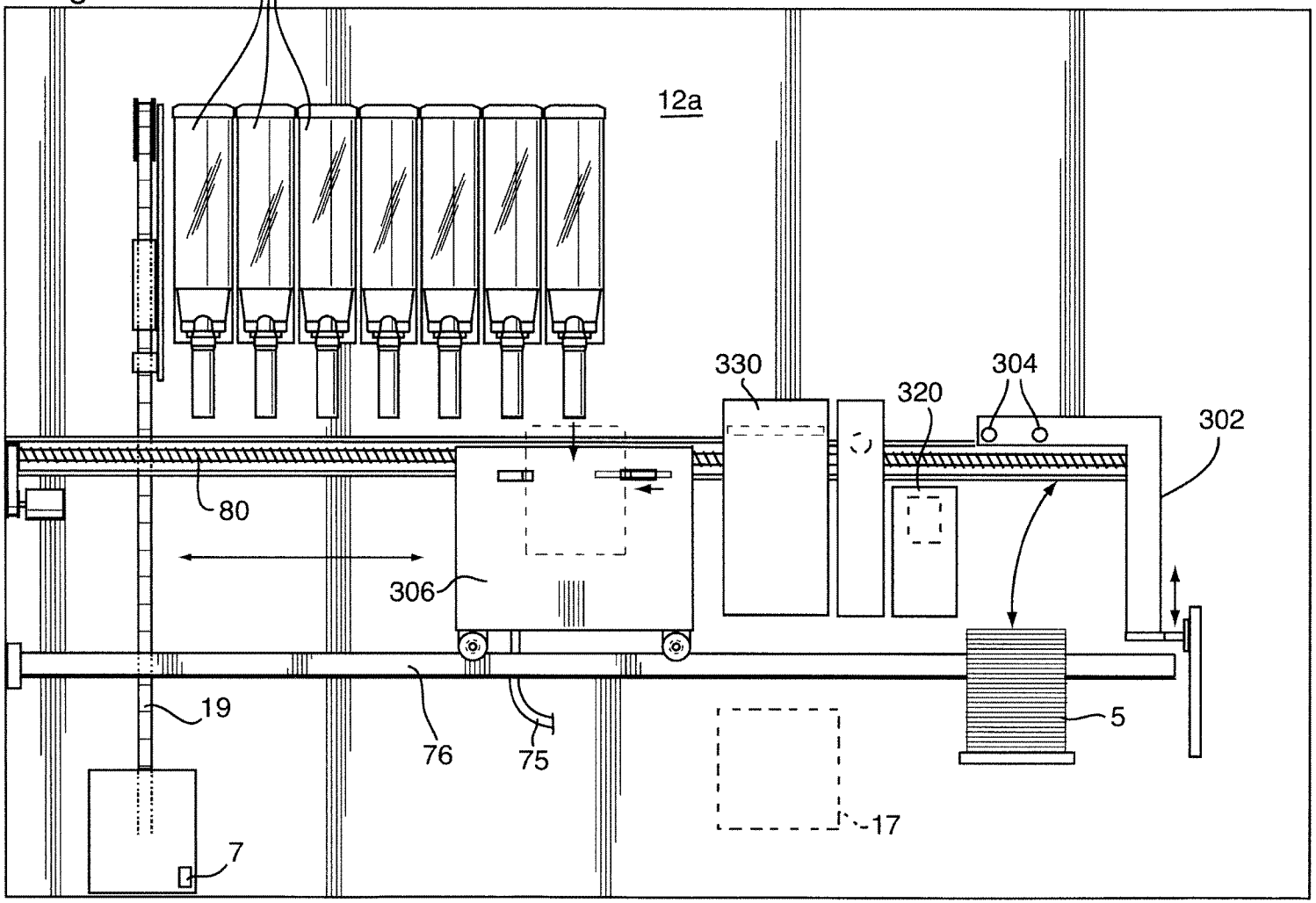
FIG. 42 is a front perspective view of the vending machine showing a combination of bulk vender modules and ribbon vender modules.

The vending machine 10 may comprise bulk venders 20 as shown, or other types of vendors and any combination thereof. For example, one or more vender modules may comprise the ribbon vender 18 described and illustrated in PCT Patent Application Serial No. PCT/CA2008/001486, which is incorporated herein by reference, with the packaged product stored beneath the vender module for dispensing as shown in FIG. 42 and described in PCT Patent Application Serial No. PCT/CA2008/001486.

In some embodiments the display 61 may provide an "attract" mode to attract purchasers to the vending machine 10. The processor may be provided with software for playing a video game via the display 61, with suitable interfaces for the purchaser such as a joystick, motion sensors or the like.

Figure 43:
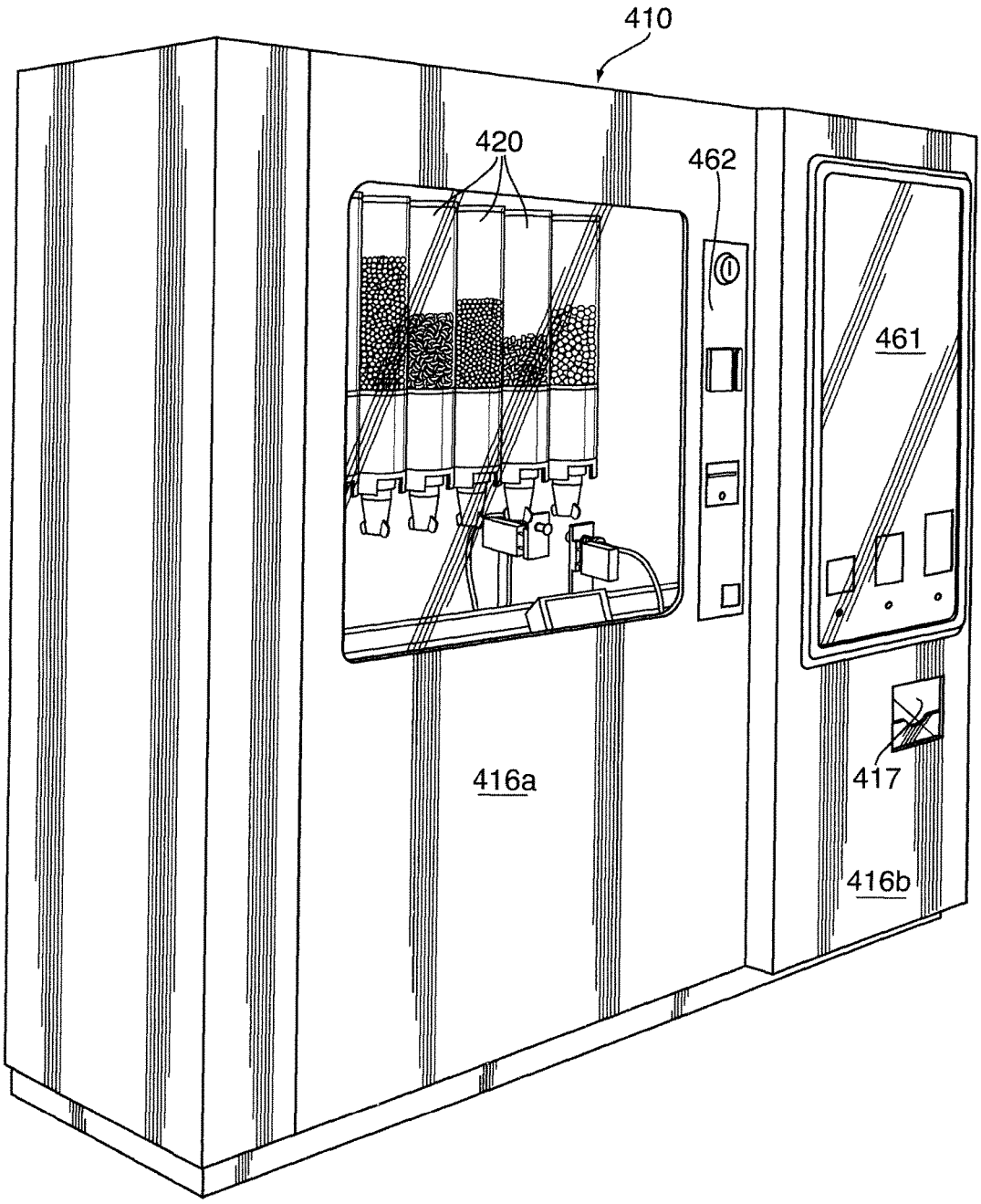
FIG. 43 is a front perspective view of a vending machine providing a further embodiment of a bagging and labelling system according to the invention.

A further embodiment of a bagging and printing/labelling system is illustrated in FIGS. 43 to 61. FIG. 43 illustrates a vending kiosk 410 having vender modules 420 mounted essentially as described above. In this embodiment, an interactive touch display screen 461, preferably with associated audio, is disposed above the dispensing opening 417. The touch screen display 461 instructs the user on available options and/or the process for purchasing merchandise from the kiosk, and serves as a control panel for instructing the processer to drive the shuttle in the manner described above. Payment is made via card/cash acceptor 462.

Figure 44:
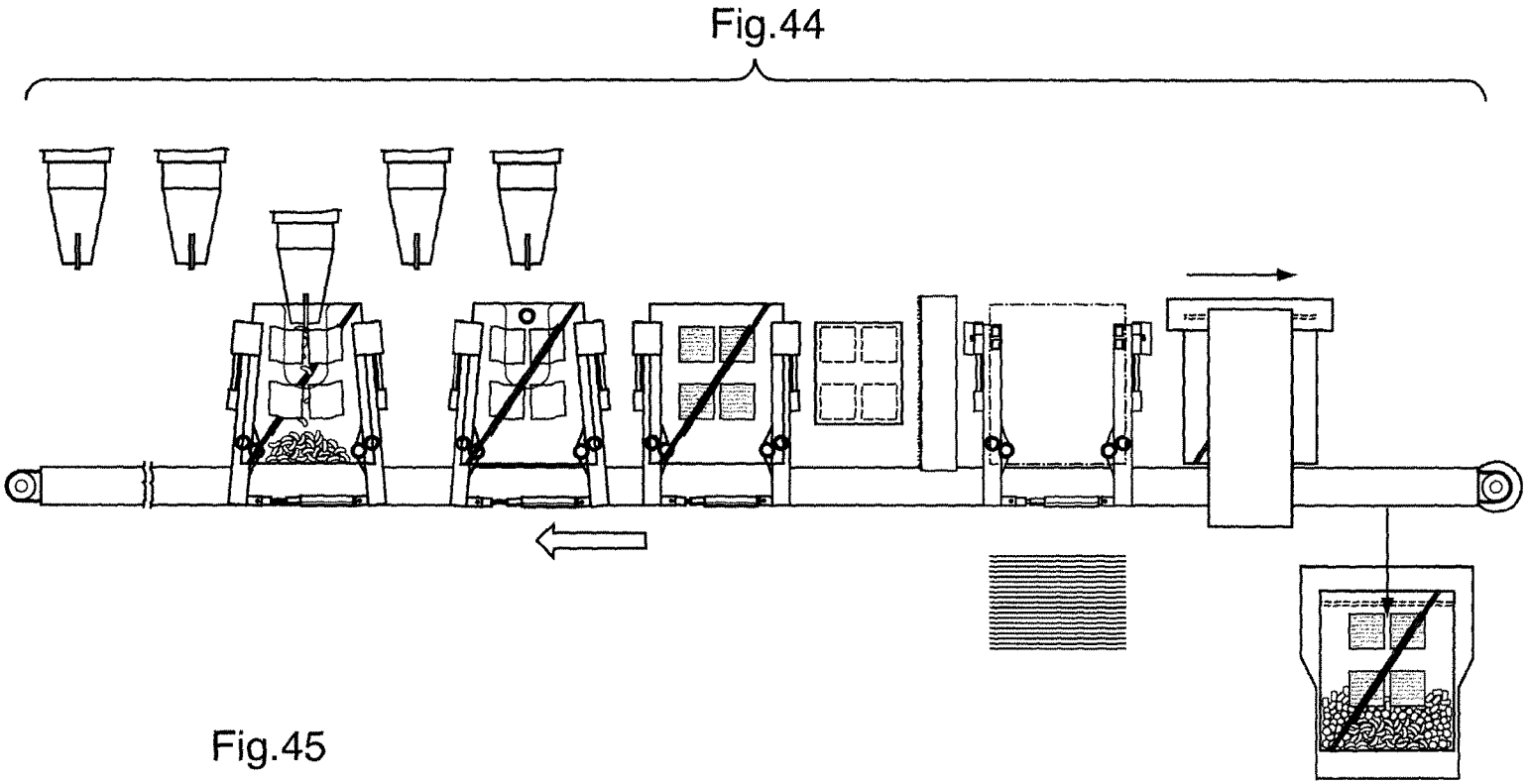
FIG. 44 is a schematic elevation of the bagging stages in the embodiment of FIG. 43.
Figure 45:
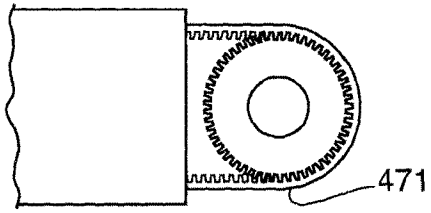
FIG. 45 is a partial elevation of a belt drive apparatus for the shuttle illustrated in FIG. 44.

FIG. 44 illustrates schematically the bagging and filling stages in accordance with this embodiment. A bag 5 is loaded into the shuttle 472 in the manner described below and driven, in this case by a belt drive 471 (shown in FIG. 45), through the bag loading, opening, filling and dispensing stages.

Figure 46:
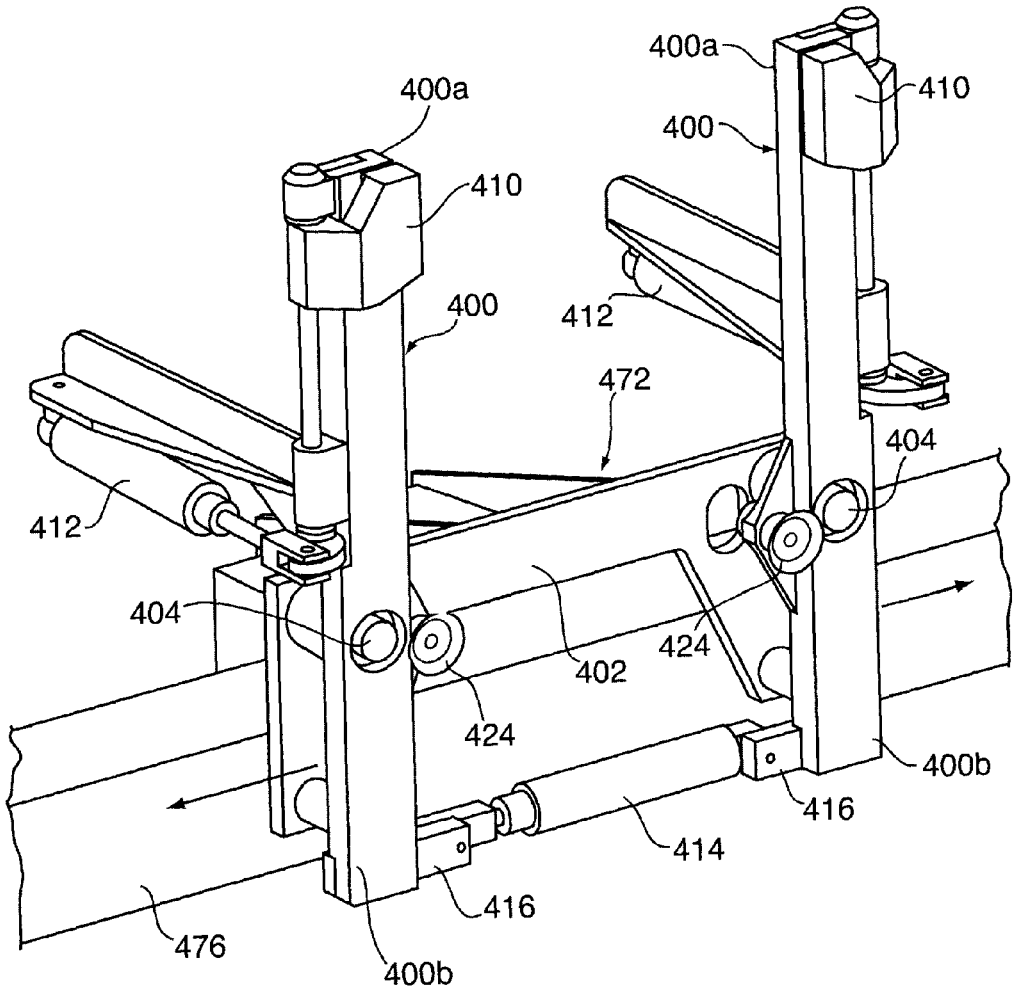
FIG. 46 is a perspective view of the shuttle illustrated in FIG. 44.

The shuttle 472 is illustrated in FIG. 46. In this embodiment, clamping arms 400 are pivotally attached to a faceplate 402 of the shuttle 472, as at pivot axles 404. The top end 400*a* of each clamping arm 400 provides a clamp 410 actuated, for example, by a pneumatic cylinder 412. The bottom ends 400*b* of the clamping arms 400 are secured to opposite ends of a bag tensioning pneumatic cylinder 414, as at pivot connections 416. The shuttle 472 is driven on rollers (not shown) along a rail 476, as in the previous embodiment, by the belt drive 471.

Figure 47:
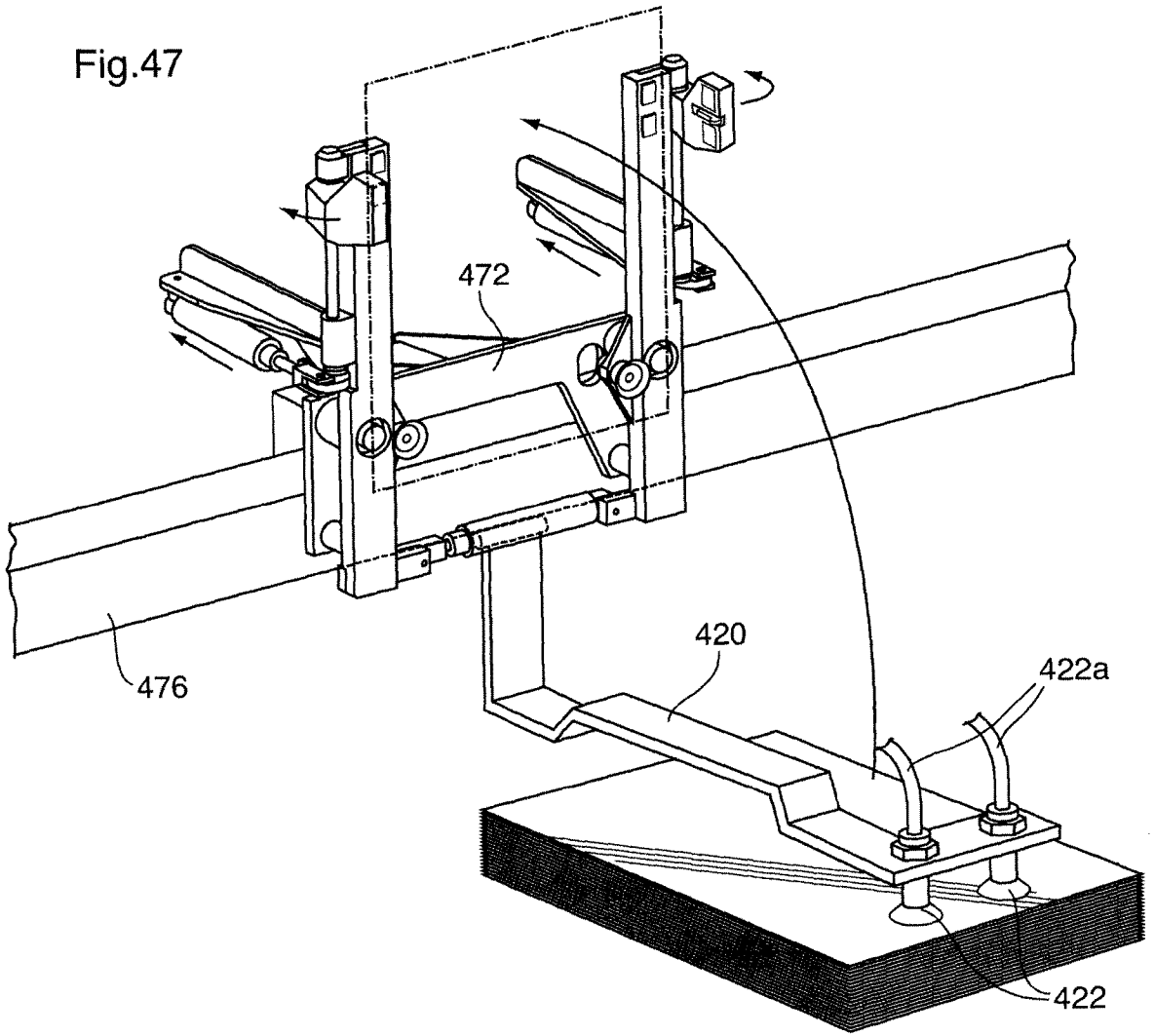
FIG. 47 is a perspective view of the shuttle of FIG. 46 in bag pickup position.
Figure 49:
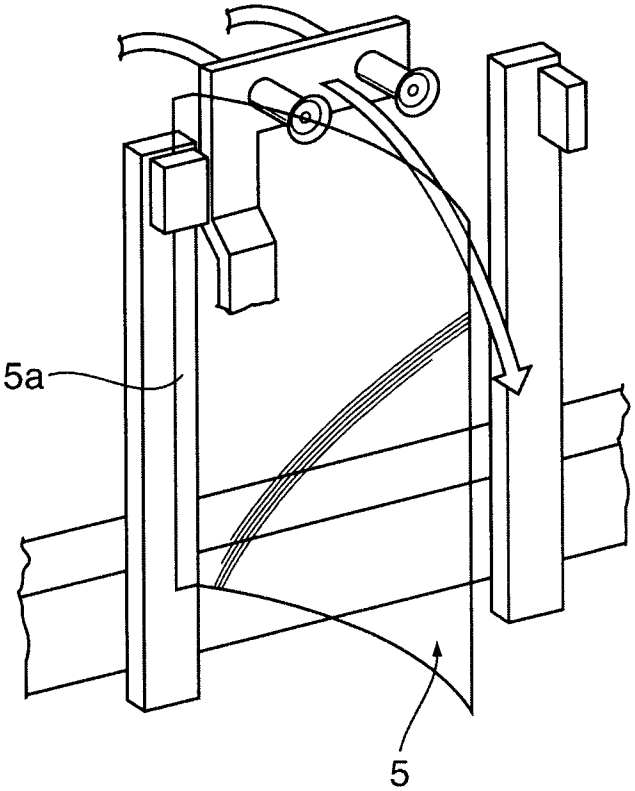
FIG. 49 is a perspective view of the shuttle of FIG. 46 with a bag partially loaded.
Figure 48:
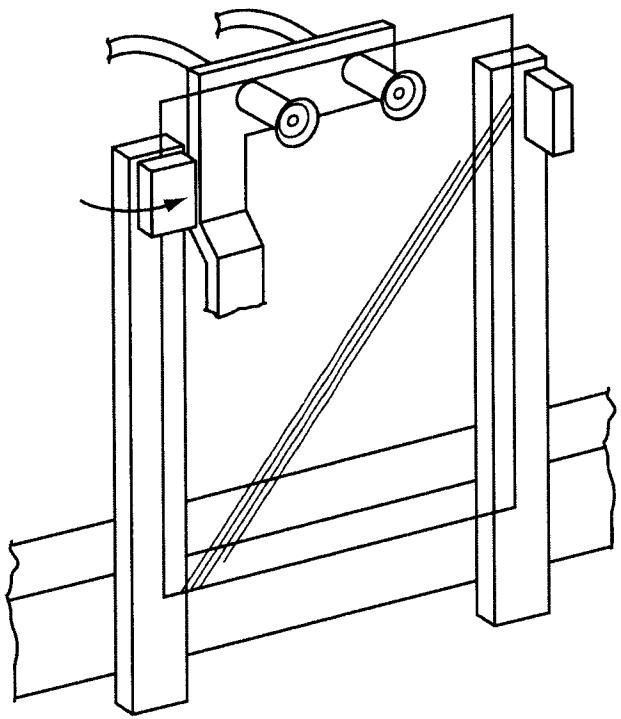
FIG. 48 is a perspective view of the shuttle of FIG. 46 in bag loading position.

In this embodiment, a bag loading device, in the embodiment shown comprising a pick up arm 420 hinged to the faceplate, as shown in FIG. 7, is provided with one or more suction devices 422 (a pair in the embodiment illustrated), which in the embodiment shown are pneumatically operated via tubes 422*a*. The bag pick up arm 420 pivots downwardly to a stack of bags 5 and the suction devices 422 are activated, releasably adhering the top bag 5 in the stack to the pickup arm 420. The pickup arm 420 swings back to the upright position, as shown schematically in FIG. 48, drawing the bag 5 against the clamping arms 400 with both clamps 410 in the opened position (as shown in FIG. 47). When the bag 5 reaches this mounted position, the clamp 410 on the leading clamping arm 400 closes, as shown in FIG. 48, and the suction devices 422 release, leaving the leading edge 5*a* of the bag 5 mounted to the leading clamping arm 400, as shown in FIG. 49.

Figure 52:
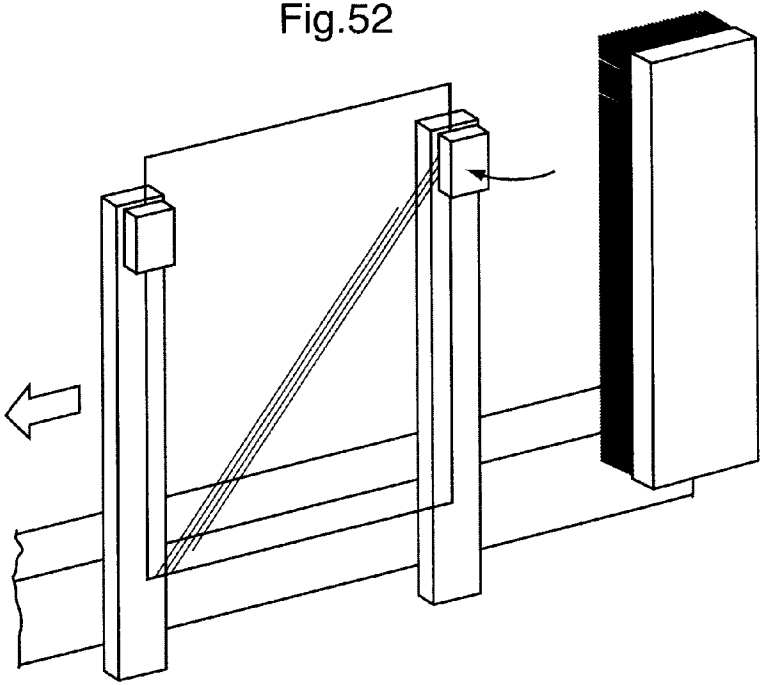
FIG. 52 is a perspective view of the shuttle of FIG. 46 with the bag fully loaded.
Figure 50:
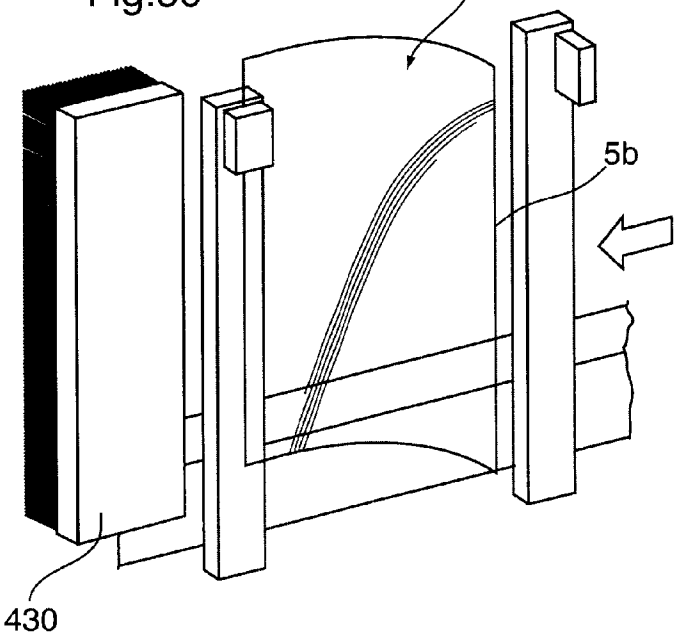
FIG. 50 is a perspective view of the shuttle of FIG. 46 moving toward a wiper brush.
Figure 51:
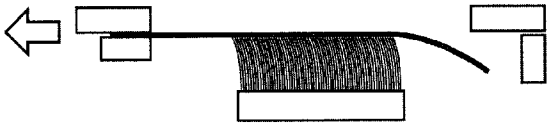
FIG. 51 is a top plan view of the bag being pulled taut by the wiper brush.

The shuttle 472 is may be drawn past a brush wiper 430, shown in FIG. 50, which presses the bag 5 taut between the clamping arms 400, as shown in FIG. 51. When the trailing edge 5*b* of the bag 5 is pressed against the trailing clamping arm 400, such that the bag 5 has been stretched taut, the clamp 410 of the trailing clamping arm 400 closes, as shown in FIG. 52, and the bag 5 is now fully mounted to the shuttle 472. Optionally suction devices 424 may be provided at intermediate portions of the clamping arms 400 (best seen in FIG. 46) in order to restrain the lower end of the bag 5 and prevent it from flapping freely.

Once the bag 5 has been secured in this fashion, as shown in FIG. 53, it is ready for printing and/or labelling as shown in FIG. 54. As described above, the print head may print directly on a bag 5, or printed labels may be applied to the bag 5, in the manner previously described. Once the bag 5 has been printed and/or labelled, the tensioning cylinder 414 is actuated, spreading the lower ends 400*b* of the clamping arms 400 apart and in turn forcing the upper ends 400*a* of the clamping arms 400 toward one another, as shown in FIG. 55. This has the effect of slackening the material around the top opening of the bag 5.

In many cases, the opposite faces of the bag 5 will slacken in opposite directions, causing the bag 5 to open fully. The bags may for example be 6.5"×7.5" (outside diameter) 2.5 ml barrier plus anti-fog, with a folded edge and a tear notch along a laser score line for easy opening by the user after sealing. However, depending upon the material used for the bag 5, in order to ensure that the bag top opens correctly for filling, a bag top opening device may be provided.

Figure 56:
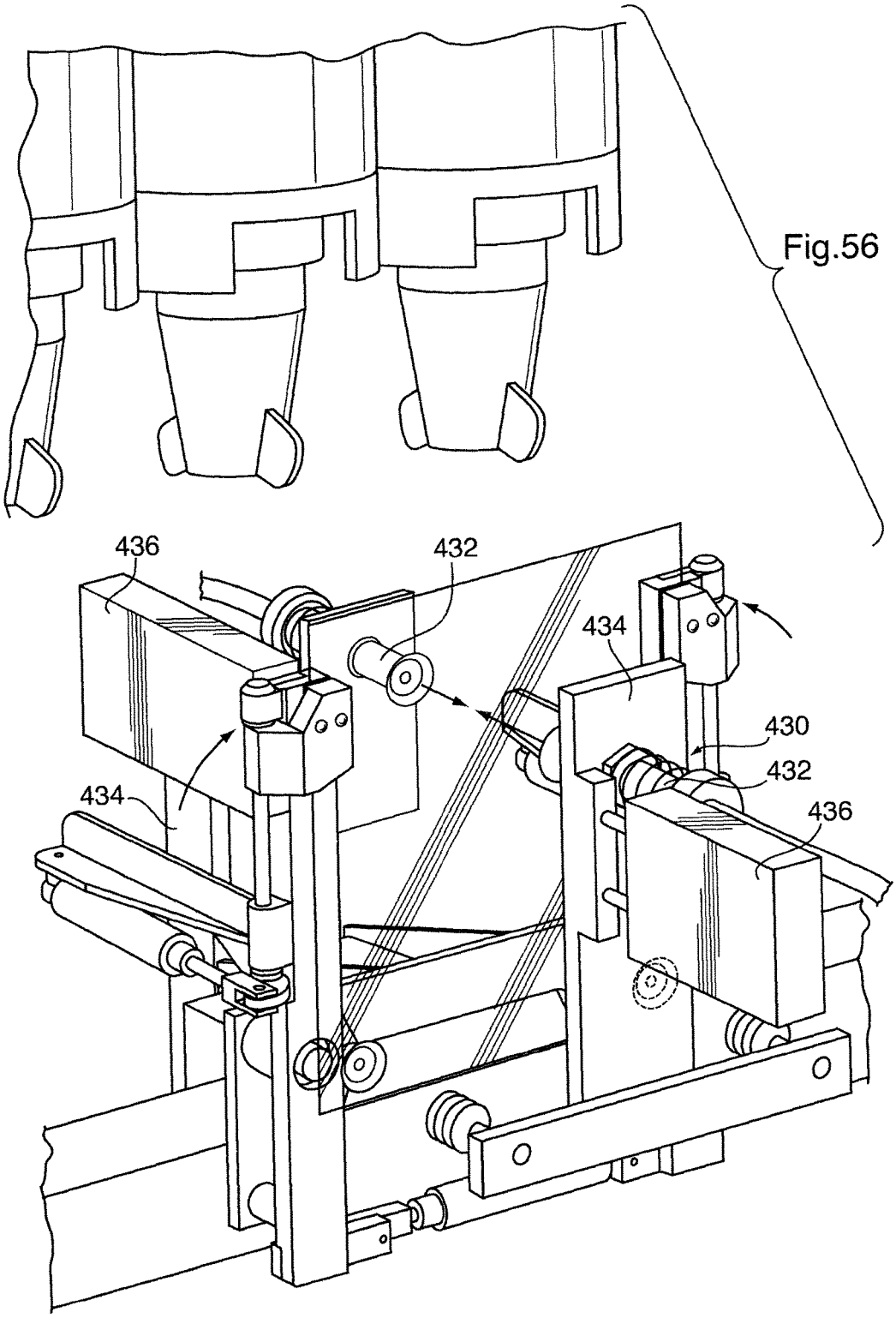
FIG. 56 is a perspective view of the shuttle of FIG. 46 with the bag positioned for opening the bag top.
Figure 61:
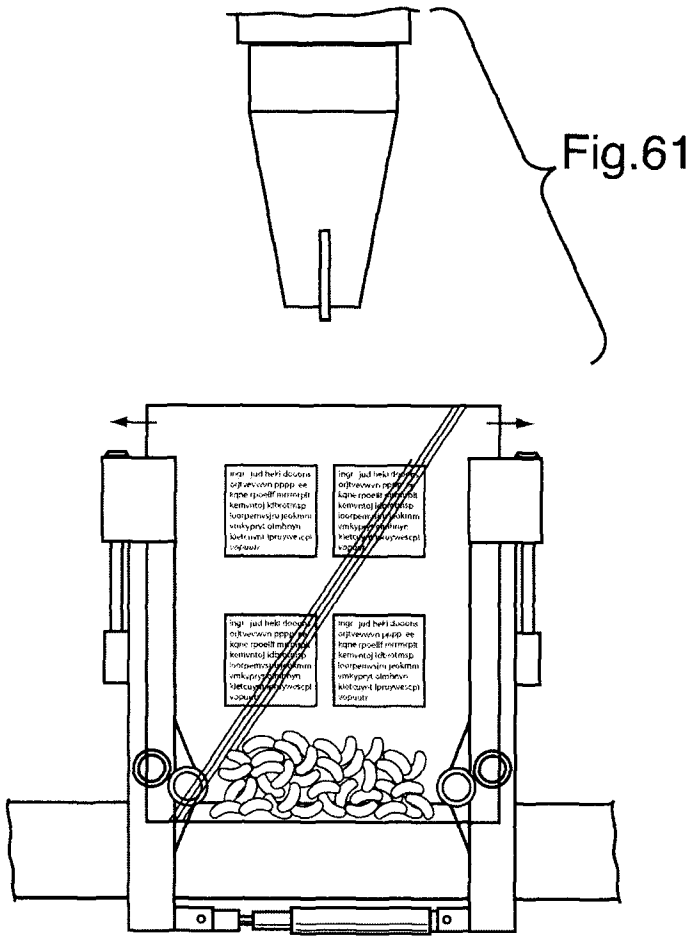
FIG. 61 is a front elevational view of the shuttle of FIG. 46 with the bag filled and the bag top returned to the taut condition.
Figure 60:
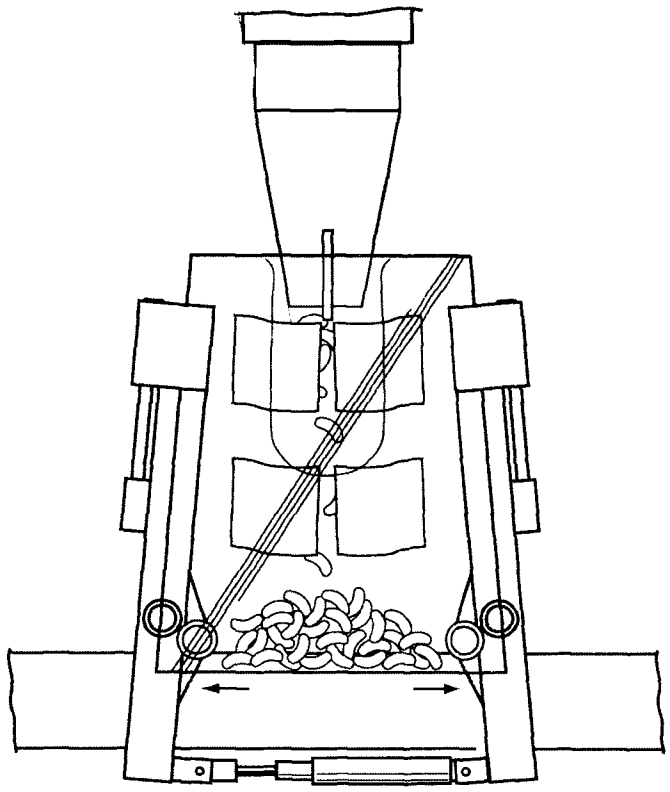
FIG. 60 is a front elevational view of the shuttle of FIG. 46 with the bag being filled.

As illustrated in FIG. 56, a bag opening device 430 comprises a pair of suction devices 432 mounted in opposed relation on either side of the shuttle at a convenient portion of the path toward the vender modules 420. Each suction device 432 is mounted to a bag opening arm 434 disposed at a level where the suction device 432 will contact an upper portion of the bag 5 as the bag clamping arms 400 are moving toward the slackening position shown in FIG. 55. The suction devices 432 may be pneumatically operated, spring-loaded, and associated with actuators 436 which push each suction device 432 toward the bag 5 into a grasping position (as shown in FIG. 58) and release to allow each suction device to return to a home position (illustrated in FIG. 59), drawing the front and rear faces near the mouth of the bag 5 apart in the process, as shown in FIG. 57. With the bag top slack and opened in this fashion, the top of the bag 5 remains opened through the filling process for as long as the tensioning cylinder 414 remains actuated, as shown in FIG. 60. When filling (by the one or more vender modules 420) is complete, the vender module chute 428 is retracted from the bag 5 in the manner described above, and the tensioning cylinder 414 is returned to the home position, which in turn returns the clamping arms 400 to a parallel position and pulls the bag 5 taut, as shown in FIG. 61.

Figure 62:
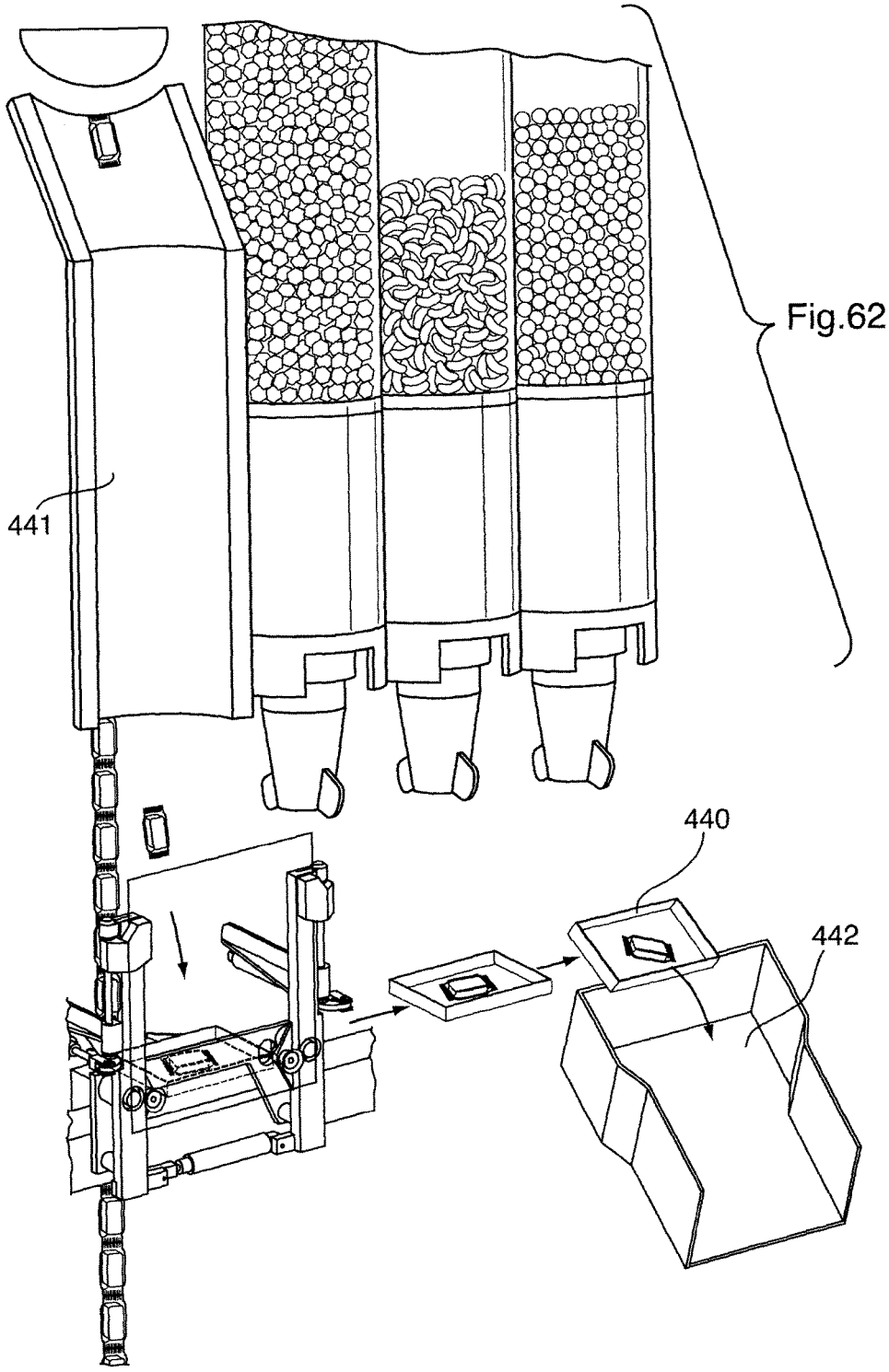
FIG. 62 is a schematic perspective view of an optional tray for dispensing an item cut from a ribbon dispensed by the ribbon dispensing module shown in FIG. 42.
Figure 63:
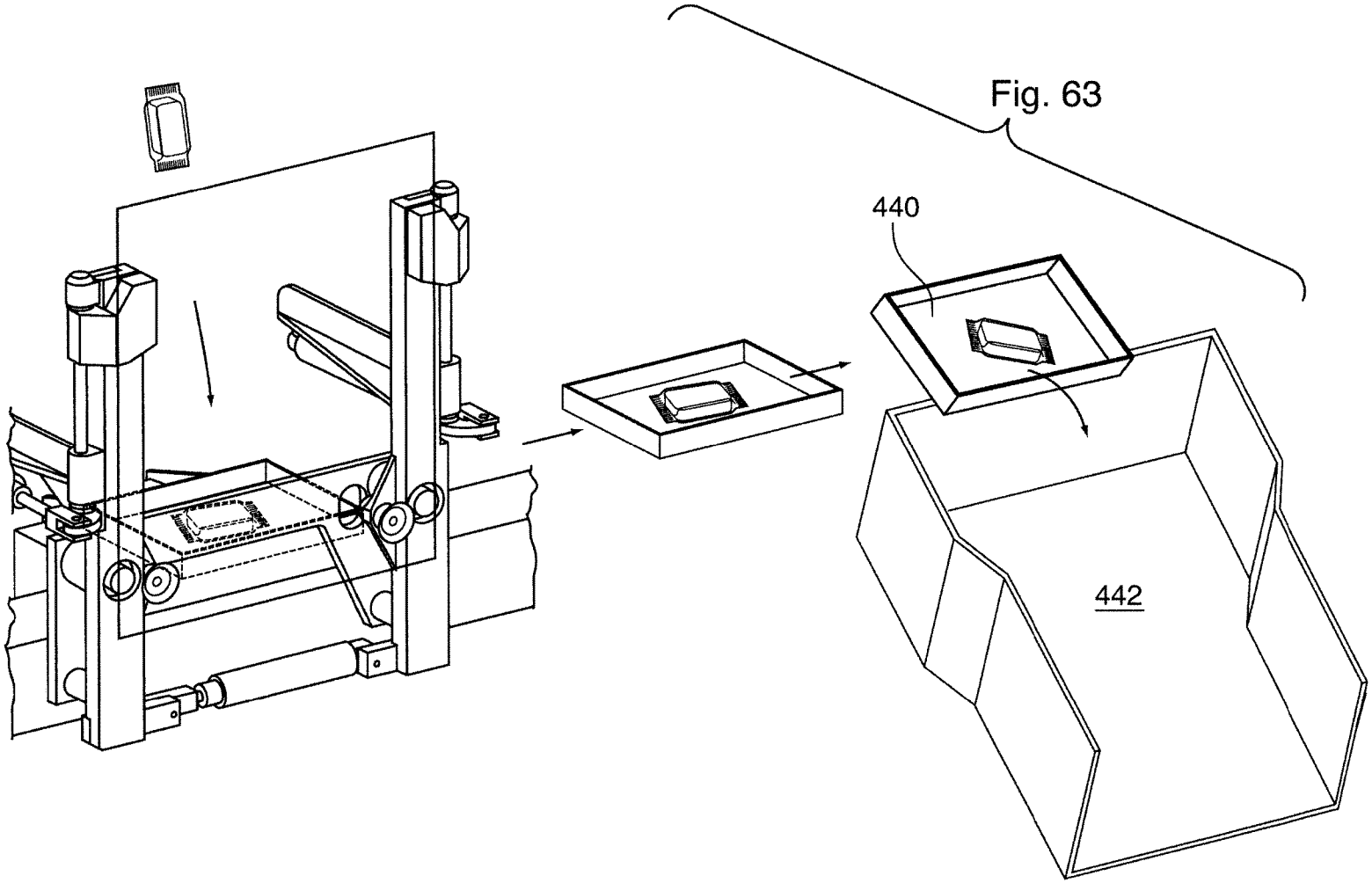
FIG. 63 is a schematic perspective view of the item cut from the ribbon being delivered to the user via the dispensing chute.

In a further exemplary embodiment of the shuttle 472, a dispensing tray 440 is provided for receiving articles dispensed from the ribbon vender module 18 illustrated in FIG. 42. As shown in FIG. 62, product fed into the module 18 is dispensed into a chute 441 which directs the product to a tray retained on top of the shuttle 472. When the shuttle 472 returns to the home position, an actuator such as a pneumatic cylinder (not shown) tilts the tray 440, ejecting the product into the dispensing opening (after the bag 5, if any, has been dispensed to the user) for access by the user. FIG. 63 illustrates schematically the process for dispensing product cut from the ribbon.

In some exemplary embodiments, the product may provide an identifier and/or other data, which may be programmed into a data-providing element such as an RFID chip 7 associated with the product. For example, as shown in FIG. 42 the carton containing the ribbon 19 dispensed by the ribbon dispenser 18 may contain or have affixed an RFID chip 7 containing a security code recognized by the vending machine control software, without which security code the vending machine 10 will not dispense the product. This can help to ensure compatibility between the various vender modules 20 and product to be dispensed. The RFID chip can also (or alternatively) be provided in or on packaging for packaged product, such as the ribbon of candy bars shown in FIG. 42, or in the capsule or casing of packaged bulk product such as encapsulated toys (not shown).

In some exemplary embodiments, the RFID chip 7 may also provide data relating to the product itself, for example an ingredients list, expiry date and/or other information. In these embodiments, the vending machine control software reads the product-related data, which data can be sent to the print head 69 to be printed onto the bag when the product is selected by a purchaser. This has the advantage of avoiding the need to pre-load ingredient and other product-related data into the vending machine control software, and ensures that the most up-to-date product information (which may for example include ingredient changes, allergy warnings etc.) is immediately available from the product as it is loaded into the vending machine 10. In the case of unpackaged bulk product, the RFID chip may be associated with the carton, bag or other container from which the bulk product is loaded into a vender module 20 by service personnel, and the data can be read from the RFID chip 7 at the time the product is loaded into the vender module 20 and stored for printing subsequently when that vender module 20 is selected by a purchaser.

In some exemplary embodiments, the products to be dispensed may optionally include a bar code, on the carton and/or on the product itself where feasible. In these embodiments, the vending machine 10 has an internal bar code reader for service personnel to scan each new carton of product as it is loaded into a vending module 20. The scanned data is used to update the internal computer vending machine 10 with the new product information.

Various exemplary embodiments of the present invention having been thus described in detail by way of example, it will be apparent to those skilled in the art that variations and modifications may be made without departing from the invention.

What is claimed is:

1. A method comprising:

bagging product in a vending machine including a plurality of venders for dispensing respective products into a top opening of a bag, wherein the bag includes a top including opposed side edges and a bag opening that extends intermediate of the side edges, the method including:

a. loading the bag to a bag holder comprising clamping arms attached to a frame, wherein the frame is in supporting connection with a plurality of clamps, wherein the frame is affixed to a shuttle that is selectively driveable in a first direction and in an opposed second direction along a path of travel to and from dispensing alignment with each of the plurality of venders, wherein each respective vender is at a respective vender location along the path of travel, wherein the respective vender location of the respective vender, differs from the locations of all the other vendors;

b. clamping opposed side edges of the bag with respective clamps to retain the bag in position for filling;

c. moving the bag along the path of travel to a selected one of the plurality of vender locations corresponding to a respective selected vender;

d. while at the selected one of the plurality of vender locations along the path of travel corresponding to the selected vender, moving at least one of the clamps from a first position in which the top of the bag is generally stretched taut and the bag opening is closed, to a second position in which the top of the bag is slackened to thereby cause the top opening of the bag to be open, wherein the bag opening is enabled to be opened and closed independently at any vender location along the path of travel to which the shuttle is driven; and e. with the bag at the selected one of the vendor locations corresponding to the selected vender and the top opening of the bag open, dispensing the product from the respective selected vender into the bag.

2. The method of claim 1 wherein in step d. both clamps are moved between the first and second positions to cause the top opening of the bag to open.

3. The method of claim 2 wherein the clamping arms are moved by an actuator attached to both clamping arms.

4. The method of claim 1 wherein step a. comprises the steps of i. moving a pickup arm to a store of bags;

ii. actuating a suction device to hold the bag; and iii. moving the pickup arm to the clamping arms.

5. The method of claim 1 comprising, before or after step c., the step of moving the shuttle along the path of travel from a pickup location to at least one dispensing location.

6. The method of claim 5 comprising, before step b., the step of moving the bag between a wiper and a surface for pressing the bag taut between the clamping arms in the first position.

7. The method of claim 6 comprising, before step c., printing information or indicia on the bag.

8. The method of claim 6 wherein step b. comprises the sub-steps of:

i. clamping a leading side of the bag; and ii. as the wiper approaches the trailing side of the bag, clamping a trailing side of the bag.

9. The method of claim 5 comprising, during or after step c., the step of applying suction to the bag to assist the opening of the bag.

10. Apparatus comprising:

a machine at which purchasers may purchase each of a plurality of bulk products held within the machine by providing inputs to at least one input device of the machine, the machine including:

a bag, wherein the bag includes a pair side edges, a top, a bottom, a bag opening, a front panel and a back panel, wherein the top includes the bag opening intermediate the side edges, wherein the bag is sealed along the pair of side edges and along the bottom, wherein the front panel and the back panel extend from the bag opening to the bottom of the bag intermediate the side edges of the bag, a bag holder, wherein the bag holder includes a shuttle, wherein the shuttle includes a shuttle face, a pair of bag clamps, wherein the bag clamps are operative to hold the bag in clamped engagement along the side edges of the bag and to position the back panel of the bag to be in engagement with the shuttle face, wherein at least one of the pair of bag clamps is movable from a first position to a second position, wherein in the first position the top of bag and the front and back panels of the bag are stretched taut against the shuttle face and the bag opening is closed, wherein in the second position the top of the bag is slackened against the shuttle face and the front panel of the bag is disposed from the back panel of the bag, and the bag opening is open, a plurality of venders, wherein each vender is configured to hold a different bulk product that is dispensable from the respective vender, wherein each vender includes a dispensing chute from which bulk product is selectively dispensable from the respective vender, a path of travel, wherein the path of travel extends horizontally and underneath the plurality of venders, wherein the shuttle is movable back and forth along the path of travel in any of a plurality of sequences to respective locations underneath each of the plurality of venders, wherein each sequence corresponds to at least one bulk product selected by a purchaser through at least one input to the at least one input device, wherein the at least one of the pair of the clamps is movable from the first position to the second position at any location along the path of travel responsive to the sequence selected by the purchaser, and wherein the at least one of the pair of clamps is movable from the second position to the first position at any location along the path of travel corresponding to the sequence selected by the purchaser, wherein the shuttle is movable along the path of travel responsive at least in part to the sequence and selectively positioned at a location underneath a selected one of the plurality of venders, wherein at the location the at least one of the pair of clamps is moved from the first position to the second position underneath the selected vender, wherein the bag receives through the bag opening, bulk material dispensed from the chute of the selected vender.

* * * * *